US006179063B1

(12) United States Patent
Borries et al.

(10) Patent No.: US 6,179,063 B1
(45) Date of Patent: Jan. 30, 2001

(54) IMPULSE WRENCH

(75) Inventors: John A. Borries, Chardon; Kenneth F. Taucher, Mentor, both of OH (US)

(73) Assignee: The Stanley Works, New Britain, CT (US)

( * ) Notice: Under 35 U.S.C. 154(b), the term of this patent shall be extended for 0 days.

(21) Appl. No.: 09/562,958

(22) Filed: May 3, 2000

Related U.S. Application Data

(60) Provisional application No. 60/132,202, filed on May 3, 1999.

(51) Int. Cl.[7] ..... B25B 21/00

(52) U.S. Cl. ..... 173/93.5; 173/93; 173/177; 173/218

(58) Field of Search ..... 173/93, 93.5, 93.6, 173/176, 177, 181, 168, 169, 104, 109, 218, 221

(56) References Cited

U.S. PATENT DOCUMENTS

| | | | | |
|---|---|---|---|---|
| 4,967,852 | * | 11/1990 | Tatsuno | 173/93.5 |
| 5,092,410 | * | 3/1992 | Wallace et al. | 173/93.5 |
| 5,217,079 | * | 6/1993 | Kettner et al. | 173/177 |
| 5,377,769 | * | 1/1995 | Hasuo et al. | 173/169 |
| 5,544,710 | * | 8/1996 | Groshans et al. | 173/176 |
| 5,901,794 | * | 5/1999 | Schoeps et al. | 173/93.5 |

* cited by examiner

*Primary Examiner*—Scott A. Smith
(74) *Attorney, Agent, or Firm*—Pillsbury, Madison & Sutro LLP

(57) ABSTRACT

The present invention relates to an impulse wrench for use in conjunction with a fastener engaging tool and a power supply to selectively rotate threaded fasteners. The wrench comprises a housing and an impulse manifold rotatably mounted within the housing. An impulse piston is mounted inside a impulse piston receiving space for reciprocating movement and has an impulse delivering surface and a pressurizing surface. The piston and the piston receiving space are constructed and arranged such that the pressurizing surface and an outer end portion of the piston receiving space cooperate to define at least a portion of a high pressure chamber which is filled with a substantially incompressible fluid. An impulse receiving portion of an output spindle and the impulse delivering portion of the impulse piston are constructed and arranged with respect to one another such that the motor rotates the manifold relative to the spindle so as to engage the impulse delivering surface of the impulse piston with the impulse receiving portion of the spindle so that (a) an impulse is delivered to the spindle to turn the spindle and the fastener engaging tool and (b) the impulse receiving portion cams the impulse delivering surface so as to move the impulse piston outwardly to increase the fluid pressure inside the high pressure chamber to a level which is related to the torsional resistance offered by the fastener. A pressure responsive shut-off structure is communicated with the high pressure chamber and movable between (a) a power communicating position and (b) a power shut-off position. The shut-off structure moves from the power communicating position thereof to the power shut-off position thereof in response to fluid pressure in the high pressure chamber reaching a predetermined level, thereby preventing power from being communicated from the power supply to the motor when the torsional resistance of the fastener has reached a predetermined level.

22 Claims, 11 Drawing Sheets

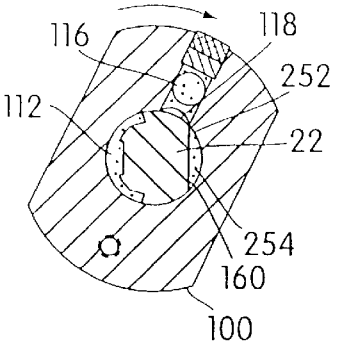
FIG. 8A
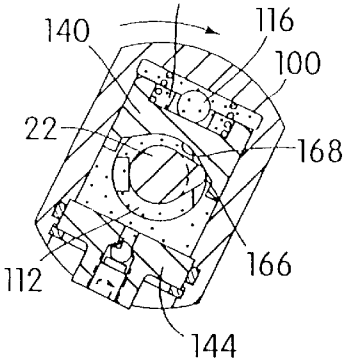
FIG. 8B
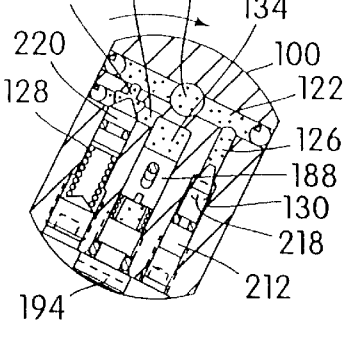
FIG. 8C
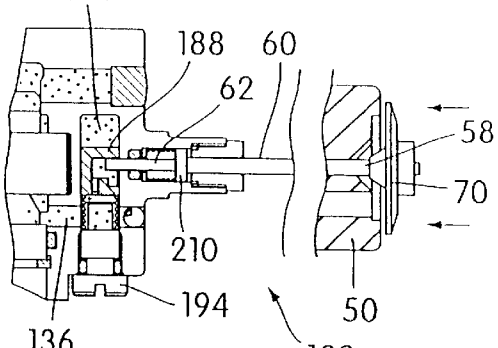
FIG. 8D
FIG. 9A
FIG. 9B
FIG. 9C
FIG. 9D

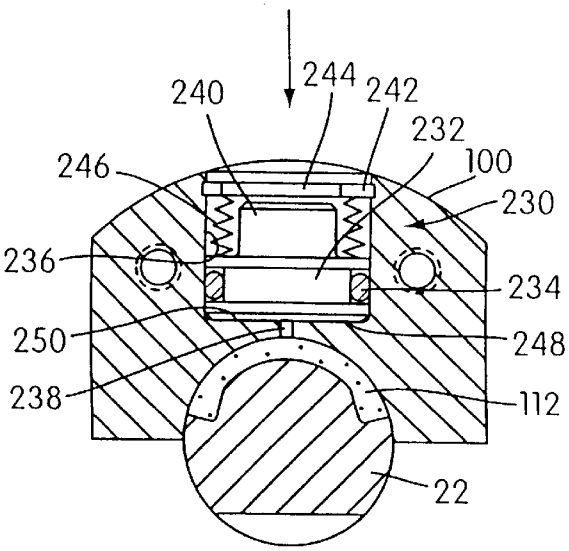
FIG. 18
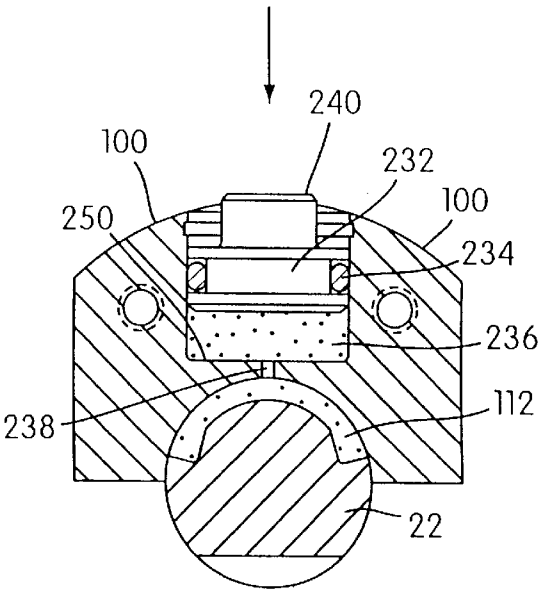
FIG. 19
FIG. 20

IMPULSE WRENCH

The present application claims priority to U.S. Provisional Patent Appln. of Borries, et al., Ser. No. 60/132,202, filed May 3, 1999, the entirety of which is hereby incorporated in the present application by reference.

FIELD OF THE INVENTION

The present invention relates to a power-operated wrench for rotating threaded fasteners and, more particularly, to a wrench that tightens fasteners to a predetermined torque.

BACKGROUND AND SUMMARY OF THE INVENTION

Impulse wrenches are known in the art for tightening threaded fasteners. Certain types of wrenches heretofore known have a rotating manifold with a large bore formed therein, and a rotating spindle having a set of spring-biased vanes mounted thereon. The bore inside the manifold is provided with a pair of diametrically opposed lands. During operation, the manifold rotates relative to the spindle so that the vanes sweep along the interior of the manifold bore. This sweeping action creates a pressure differential on opposing sides of the vanes. When the vanes contact the lands, the spindle and manifold are momentarily coupled together in a force transmitting relationship and a rotary impulse is transmitted to the spindle through the vanes, thereby affecting a turning movement of the spindle and the fastener to which it is engaged.

These types of wrenches require extremely tight tolerances when forming the bore inside the manifold to ensure the vanes can sweep properly along the bore interior. As a result of such tolerances requirements, the cost of manufacturing such wrenches is relatively high.

Other types of arrangements for delivering impulses to the spindle have also been provided in the art. U.S. Pat. No. 3,210,959 to Brown discloses an arrangement wherein the manifold carries a single-acting piston that slides in a reciprocating manner within a radial bore formed in the impulse manifold. The output spindle has an eccentric portion disposed adjacent the radial piston. During a fastener tightening operation, the manifold rotates relative to the spindle such that the piston engages the spindle once each rotation to deliver a rotary impulse to the spindle. An overflow chamber is communicated to a chamber defined in part by the radial piston via a restricted orifice. As the eccentric portion of the spindle contacts the piston, the piston is cammed radially outwardly and pressurized fluid is forced through the restricted orifice. As a result, the piston rides over the eccentric spindle portion and then a return spring forces the piston back towards the spindle. When the torsional resistance of the fastener reaches a selected maximum level, a sufficient amount of fluid is forced out through the restricted orifice during each rotation to enable the piston to ride over the eccentric spindle portion without delivering sufficient force to further tighten the fastener. The maximum level for the torsional resistance of the fastener can be adjusted by turning a screw to vary the restriction of the orifice.

U.S. Pat. No. 5,735,354 discloses a piston-type arrangement that uses a single double-acting piston, and in another embodiment a piston-type arrangement using a pair of diametrically opposed pistons.

The advantage of a piston-type arrangement is that the high manufacturing expenses associated with machining the manifold bores for the vane-type arrangements within close tolerances are avoided. However, neither of the radial piston arrangements disclosed in the patents mentioned above have a suitable mechanism for shutting off the flow of power to the tool. In the '959 patent, the maximum torque level is set by varying the restriction of the aforementioned orifice by tightening or loosening a screw. The wrench of the '959 patent itself, however, continues to run after the threshold torque level has been reached. Thus, a user must visually verify that the maximum torque level has been reached by watching to see if the fastener is continuing to be tightened. As a result, the user may have a tendency to keep running the wrench more than necessary during each operation to ensure that the fastener is tightened. It can be appreciated that in high usage applications, such as in automobile assembly plants, extra running of the wrench can quickly add up over time and cause unnecessary premature wear on the wrench components.

The '354 patent does not disclose any mechanism for shutting off the power to the wrench or for ensuring that the torque applied by the fastener does not exceed a predetermined level. However, the applicants of the present application are aware of a commercially available impulse mechanism (the mechanism includes the manifold and the spindle, not the entire wrench) available from Robert Bosch GmbH, the assignee of the '354 patent, that is similar to the double-acting piston arrangement disclosed in the '354 patent. The Bosch mechanism uses a deceleration-sensitive shut-off structure for stopping the flow of power to the wrench. Deceleration-sensitive shut-off structures are problematic because they often measure the torque applied to the fastener inaccurately. Specifically, deceleration-sensitive shut-off structures measure the rotational deceleration of the wrench components to determine the torque being applied to the fastener. This method of measuring torque is inaccurate when tightening fasteners and using fastener engaging tools (i.e., the sockets used for engaging threaded bolts) of varying weights because these weights will affect the overall deceleration of the wrench components, thus resulting in inconsistent measurements and inconsistent torque delivery between fasteners of varying weights. In addition, these deceleration-sensitive mechanisms must be periodically adjusted to ensure the proper torque is being delivered.

Thus, there exists a need for a piston-type wrench that has a shut-off structure that functions effectively and consistently to shut-off power to the wrench when a fastener has been tightened to a preset torque. To meet this need, the present invention provides an impulse wrench for use in conjunction with a fastener engaging tool and a power supply to selectively rotate threaded fasteners. The wrench comprises a housing and an impulse manifold rotatably mounted within the housing. The manifold has a spindle receiving space and an impulse piston receiving space. An impulse delivering piston is mounted inside the impulse piston receiving space for reciprocating movement and has an impulse delivering surface and a pressurizing surface. The piston and the piston receiving space are constructed and arranged such that the pressurizing surface and an outer end portion of the piston receiving space cooperate to define at least a portion of a high pressure chamber which is filled with a substantially incompressible fluid.

An output spindle is rotatably mounted within the spindle receiving space and has an impulse receiving portion positioned adjacent the impulse delivering surface of the impulse piston. The output spindle connects with the fastener engaging tool such that rotation of the spindle rotates the fastener engaging tool. A power-operated motor is operatively connected to the impulse manifold. The motor is constructed and arranged to rotate the manifold about the driving axis thereof using power from the power supply. An actuator is selectively movable between (a) an actuated position enabling the power supply to communicate power to the motor and (b) a non-actuated position preventing the power supply from communicating power to the motor.

The impulse receiving portion of the output spindle and the impulse delivering portion of the impulse piston are constructed and arranged with respect to one another such that, when the motor is connected with the power supply and the fastener engaging tool is connected with the spindle and engaged with a threaded fastener, movement of the actuator to the actuated position thereof communicates power from the power supply to the motor to cause the motor to rotate the manifold relative to the spindle, thereby momentarily engaging the impulse delivering surface of the impulse piston with the impulse receiving portion of the spindle so that (a) an impulse is delivered to the spindle to apply torque to the spindle which in turn transmits the torque to the fastener engaging tool and the fastener engaged therewith and (b) the impulse piston moves such that the pressurizing surface thereof increases the fluid pressure inside the high pressure chamber to a level which is related to the torsional resistance to tightening offered by the fastener. An adjustable pressure responsive shutoff structure is communicated with the high pressure chamber and is movable between (a) a power communicating position wherein the shut-off structure permits the power supply to communicate power to the motor and (b) a power shut-off position wherein the shut-off structure prevents the power supply from communicating power to the motor. The shut-off structure moves from the power communicating position thereof to the power shut-off position thereof in response to fluid pressure in the high pressure chamber reaching a shut-off initiating level that is related to a selected maximum amount of torsional resistance to which the fastener is to be tightened, thereby preventing power from being communicated from the power supply to the motor when the torsional resistance of the fastener has reached the selected maximum amount. This prevents power from being communicated from the power supply to the motor when the torsional resistance of the fastener has reached the maximum amount.

The shut-off structure is constructed and arranged such that the shut-off initiating level of the fluid pressure in the high pressure fluid chamber at which the shut-off structure moves to the power shut-off position can be adjusted, thereby allowing for selective control of the maximum torsional resistance for the fastener.

The use of a pressure-sensitive shut-off structure that responds to pressure created as a result of the piston engaging the engaging portion of the spindle provides a consistent and accurate measurement of fastener torque, which in turn provides a consistent and accurate shut-off of power to the motor. Specifically, the pressure created by the piston moving outwardly is directly related to the amount of torsional resistance offered by a fastener. An increase in torsional resistance of the fastener results in an increase of pressure in the high pressure chamber during each piston movement. The pressure created by the piston is not affected by the weight of the fastener or other such variable factors, as is the problem with measuring deceleration of wrench components. Thus, measuring the pressure ensures a direct and accurate measurement of the fastener's torsional resistance without the inconsistencies created by other indirect torque measuring methods, such as deceleration measurements.

It is to be understood that this aspect of the present invention is not limited to the single-acting piston arrangement disclosed herein and may be practiced with any of the arrangements shown in the aforementioned '354 patent, the entirety of which is hereby incorporated into the present application. However, its is preferred to practice the principles of the present invention using a single-acting piston arrangement because a single-acting piston takes up less volume than a double-acting piston, which in turn allows more oil or another substantially incompressible fluid to be used in the manifold. Because of this increased fluid capacity in a single-piston arrangement, a greater volume of fluid can be used and thus the fluid temperature will increase less rapidly during operation than in comparison to a lower volume of fluid. As a result, the fluid in the single-acting piston design will need to be changed less often. Further, this aspect of the invention may be practiced with power-operated motors other than the air-powered motor disclosed herein. The motor may be powered by pressurized liquid or by electricity. In the case of using pressurized liquid as the power supply, a valve mechanism would still be suitable. However, a switch would be used when an electric power supply is used. Further, the principles of the present invention may also be practiced with the axial piston arrangement shown in EP 0631851 to Robert Bosch GmbH, the entirety of which is incorporated into the present application by reference.

Another aspect of the present invention relates specifically to fluid powered wrenches that use a movable valve to shut-off power to the motor. These valves reciprocate between open and closed positions to allow and prevent the flow of fluid to the motor. However, most of these wrenches use a complicated mechanism for moving the valve to its closed position. In such mechanisms, the fluid pressure usually resists such movement of the valve and thus the mechanism must actively move the valve.

U.S. Pat. No. 5,082,066, discloses an arrangement wherein pressurized air flowing from the power supply biases the valve towards its closed position. The valve is maintained in its open position during normal operation, and then allowed to move to its closed position under the force of the pressurized air. This arrangement is advantageous because it obviates the need for the complicated mechanisms required to force the valve against the resistance of pressurized air used in some wrenches. The problem with the arrangement disclosed in the '066 patent is that movement of the valve therein to its closed position is affected by a declaration-sensitive arrangement for measuring fastener torque. As discussed above, declaration-sensitive mechanisms may be inaccurate and inconsistent. As a result, the timing of the valve's movement to its closed position for power shut-off will also be inaccurate and inconsistent.

Thus, there exists a need for an impulse wrench in which the need for complicated mechanisms that move a valve against the resistance of pressurized fluid is obviated and also which is provided with an improved mechanism for measuring fastener torque. To meet this need, another aspect of the present invention provides an impulse wrench for use in conjunction with a fastener engaging tool and a supply of pressurized fluid to selectively rotate threaded fasteners. The wrench comprises a housing and an impulse transmitting mechanism mounted in the housing. The mechanism comprises a driven component, an output spindle, and surfaces defining a high pressure chamber filled with a substantially incompressible fluid. The output spindle is mounted for rotation with respect to the housing and connectable with the fastener engaging tool such that rotation of the spindle rotates the fastener engaging tool. A fluid-driven motor is operatively connected to the driven component. The motor is constructed and arranged to rotate the driven component using pressurized fluid from the supply. The driven component is rotatable with respect to the housing and the output spindle such that rotation of the driven component rotates the spindle to affect a fastener tightening operation wherein the threaded fastener is tightened in such a manner that its torsional resistance to tightening increases throughout the operation. The impulse mechanism is constructed and arranged such that the pressure of the fluid in the chamber increases to a level that is related to the torsional resistance offered by the fastener increases during the fastener tightening operation.

An adjustable pressure responsive shut-off structure is communicated with the high pressure chamber. The shut-off structure has a shut-off valve that moves between (a) a power communicating position wherein the shut-off valve permits the pressurized fluid to flow from the supply thereof to the motor and (b) a power shut-off position wherein the shut-off valve prevents the pressurized fluid from flowing from the supply thereof to the motor. The shut-off valve is positioned between the motor and the supply of pressurized fluid such that the pressurized fluid flows against the valve so as to apply a biasing force that urges the valve towards the power shut-off position thereof. The shut-off structure maintains the shut-off valve in the power communicating position thereof while the pressure of the fluid in the high pressure chamber is below a selected shut-off initiating level that is related to a selected maximum amount of torsional resistance to which the fastener is to be tightened and thereafter allows the valve to move to the power shut-off position thereof under the biasing force applied by the pressurized fluid flowing from the supply thereof in response to the pressure of the fluid in the high pressure chamber reaching the shut-off initiating level, thereby preventing the pressurized fluid from being communicated from the supply thereof to the motor when the torsional resistance of the fastener has reached the selected maximum amount.

The shut-off structure is constructed and arranged such that the shut-off initiating level of the fluid pressure in the high pressure fluid chamber at which the shut-off structure moves to the power shut-off position can be adjusted, thereby allowing for control of the maximum torsional resistance for the fastener.

This aspect of the present invention is not limited to the disclosed piston-type impulse mechanism. Instead, this aspect of the invention may be practiced with clutch-type mechanisms, such as that shown in U.S. Pat. No. 4,635,731, or with the vane-type mechanisms discussed above, such as those shown in U.S. Pat. Nos. 5,080,181 and 5,217,079, the entirety of each of these patents being incorporated into the present application by reference. Also, the principles of this aspect of the invention may be practiced with the axial piston arrangement shown in EP 0631851 to Robert Bosch GmbH, the entirety of which is incorporated into the present application.

Other objects, features, and advantage of the present invention will become apparent from the foregoing detailed description, the accompanying drawings, and the appended claims.

BRIEF DESCRIPTION OF THE DRAWINGS

FIGS. 8A–8D are views similar to FIGS. 6A–6D but showing the positions of the components illustrated therein when the impulse manifold is rotated approximately 2720 from its initial position;

FIGS. 9A–9D are views similar to FIGS. 6A–6D but showing the positions of the components illustrated therein when the impulse manifold is rotated approximately 56° from its initial position;

FIG. 18 is a cross-sectional view similar to FIG. 15 but inverted showing a plug being assembled into a chamber formed in the impulse manifold;

FIG. 19 is a view similar to FIG. 18 with the plug and the chamber cooperating to define the reservoir;

FIG. 20 is a view similar to FIG. 19 with a retaining ring being positioned to prevent removal of the plug from the chamber and a spring disposed between the ring and the plug to bias the plug to the position of FIG. 15.

DETAILED DESCRIPTION OF THE PREFERRED EMBODIMENT OF THE INVENTION

Figure 1:
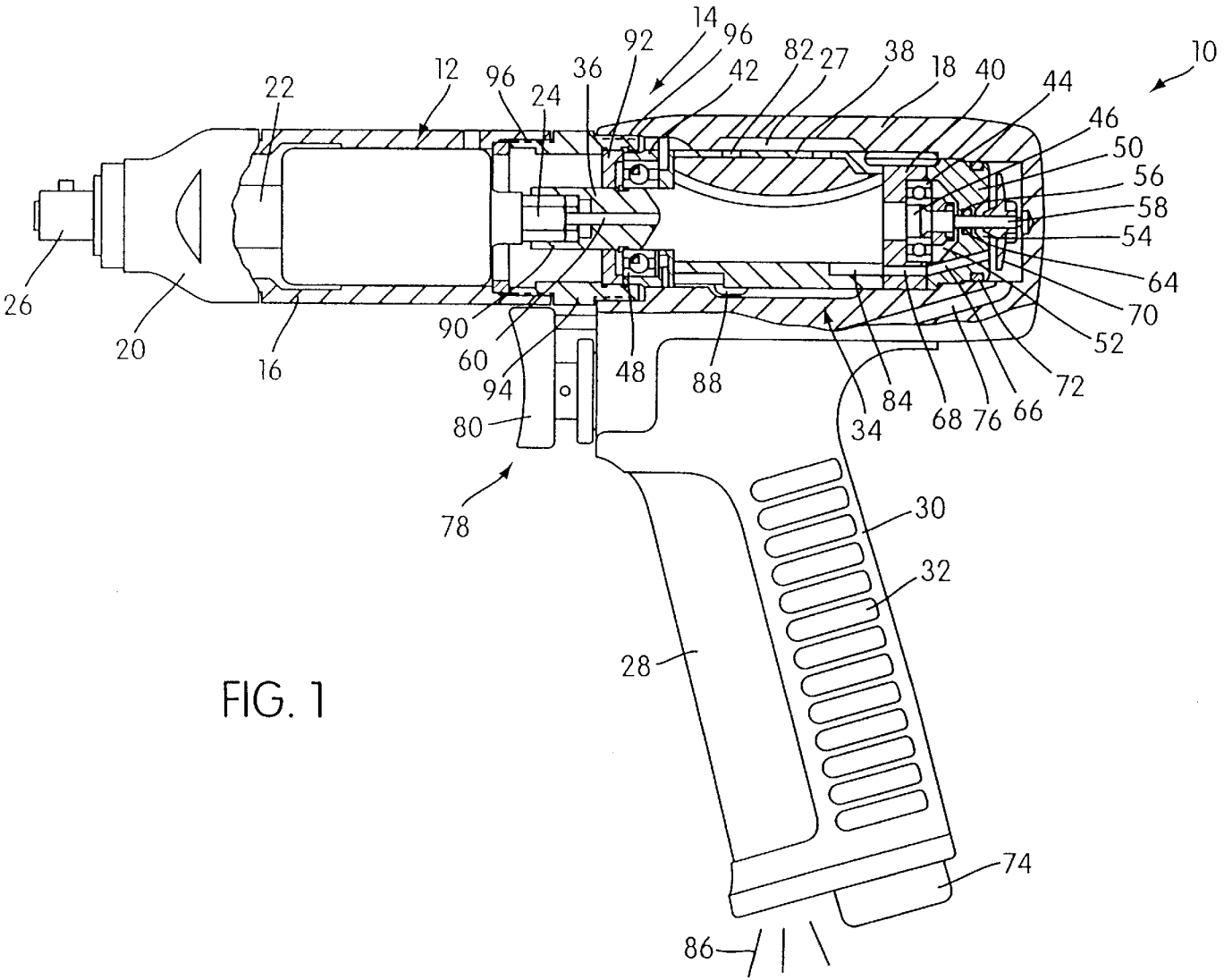
FIG. 1 is an elevated profile view of an impulse wrench constructed in accordance with the principles of the present invention, the view being shown partially in section to better illustrate the internal components of the wrench.

FIG. 1 shows an impulse wrench, generally indicated at 10, constructed in accordance with the principles of the present invention. The wrench 10 is used for rotatably tightening and loosening threaded fasteners (not shown) and includes an impulse transmitting mechanism, generally indicated at 12, that enables the wrench 10 to tighten such fasteners to a pre-determined maximum torque. The wrench 10 includes a housing 14 which has a generally cylindrical forward housing portion 16 and a rear housing portion 18. The forward housing portion 16 a machined component and the rearward housing portion 18 is a one-piece molded component or a one-piece casting that is machined to its final configuration.

The forward housing portion 16 has a hollow interior and a nose portion 20 mounted thereto with a tapered forward end. The impulse transmitting mechanism 12 is positioned inside the forward housing portion 16 with an output spindle 22 thereof extending forwardly from the mechanism 12. A forward end portion of the output spindle 22 is connected with a tool mounting portion 26 disposed forwardly of the nose portion 20. A motor connecting portion 24 of the mechanism 12 extends rearwardly therefrom. The tool mounting portion 26 is configured to have a fastener engaging tool (not shown) removably mounted thereto. The fastener engaging tool may be of any kind which is suitable for engaging and rotating a threaded fastener. A typical example of such a tool is a socket wrench-type tool suitable for rotating lug nuts, such as those which fasten structural components in an automobile together and those which fasten the rim of an automobile wheel in place. The fastener engaging tool may be selected from a kit having fastener engaging tools of varying sizes.

The rearward housing portion 18 has a hollow cavity 27 and a pistol grip portion 28 formed integrally therewith. The pistol grip portion 28 is covered with a deformable material 30, such as foamed rubber, to provide for suitable non-slip grasping. A series of indentations (or ribs) 32 may be formed on the material 30 to enhance such non-slip grasping.

A power-operated motor, generally indicated at 34, is mounted inside the hollow interior of the rearward housing portion 16. In the disclosed embodiment, the motor 34 is powered by pressurized air. However, the principles of the present invention may be practiced using electricity, pressurized fluids, or any other suitable source of power.

The motor 34 has a generally cylindrical tubular casing 38 and a rotatable shaft 36 mounted inside the casing 38. The shaft 36 has a plurality of vanes which are not shown for clarity reasons. However, it is well known in the art to rotate a shaft with vanes thereon using pressurized air. Forward and rearward shaft supporting blocks 40,42 each having generally cylindrical configurations and central bores formed therethrough are positioned adjacent to and in abutting relation with the forward and rearward ends of the casing 38. The central bore of the rearward shaft supporting block 40 has a wider diameter portion opening rearwardly and in which a ball bearing assembly 44 is received. The ball bearing assembly 44 rotatably supports the rearward end portion 46 of the shaft 36. The central bore of the forward shaft supporting block 42 has a wider diameter portion opening forwardly and in which a ball bearing assembly 48 is received. The ball bearing assembly 48 rotatably supports a portion of the shaft 36 spaced rearwardly of the forward end thereof.

The motor 34 also includes a valve supporting structure 50 that is connected rearwardly of the casing 38 and the supporting block 40. The valve supporting structure 50 has a central bore with a frustroconical forward portion 52, a frustroconical rearward portion 54, and a central passage 56 communicating the two portions 52, 54. A rearward end portion 58 of a valve actuating rod 60 extends from the shaft 36 and through the central bore in valve supporting structure 50. The shaft 36 has a bore that extends throughout the length thereof and the rod 60 is slidably mounted inside the bore. A forward end portion of the rod 60 extends forwardly from the shaft 36 and is engaged with a plunger 62 that that is located within the impulse transmitting mechanism 12. The interaction between the transmitting mechanism 12 and the rod 60 will be described in further detail later in the application. A sealing element in the form of an annular rubber O-ring 64 is disposed inside the connecting passage 56 and sealingly engaged with the rod 60 to prevent pressurized air from flowing through the central bore of valve supporting structure 50.

The valve supporting structure 50 has a fluid passageway 66 formed therethrough beneath its central bore and opening to the forwardly and rearwardly facing surfaces of the structure 50 of the block 40. The shaft support block 40 also has a fluid passageway 68 formed therethrough beneath its central bore and opening to the forwardly and rearwardly facing surfaces of the structure 50 of the block 40. When the support block 40, the valve supporting structure 50, and the casing 38 are assembled together, the fluid passageways 66, 68 are fluidly communicated with one another and with the interior of the tubular casing 38. A disc-shaped valve member 70 is fixed to the rearward end portion 58 of rod 60. The valve member 70 and the rod 60 move together between (a) an open position (shown in FIG. 1) wherein the valve member 70 is spaced from passageway 66 to allow air to flow through the passageways 66, 68 and into the casing interior and (b) a closed position (as shown in FIGS. 9–12) wherein the valve member 70 engages the rearwardly facing surface of valve supporting structure 50 and closes the passageway 66 in a sealing manner to prevent air from flowing through passageways 66, 68 and into the casing interior. The valve member 70 and actuating rod 60 may be considered part of a shut-off structure 102 whose full function and construction will be explained in further detail later in the application. These open and closed positions may be considered to provide the power communicating and the power shut-off positions of the shut-off structure.

The motor 34 is assembled together and positioned inside the cavity 27 of the rearward housing portion 18. A sealing element in the form of an annular rubber O-ring 72 is received within a groove which extends around the periphery of the valve supporting structure 50. The O-ring 72 engages the interior surfaces defining cavity 27 in sealed relation to prevent air from flowing around the exterior of the valve supporting structure 50. Sufficient space is provided between the rear surface of the valve supporting structure 50 and the rear wall of the housing 14 to allow for movement of the valve member 70 between its open and closed positions.

An air supply connecting portion 74 is provided at the lower end of the pistol grip portion 28 and is adapted for connection to a supply of pressurized air (not shown). A fluid passageway 76 fluidly communicates the air supply connecting portion 74 (and hence the pressurized air supply when connected) to the rear end of the interior cavity 27. When the valve member 70 is in its open position, fluid communication is established between the fluid passageways 66, 68, the interior of casing 38, and fluid passageway 76, thereby allowing pressurized air to flow from the air supply and into the casing interior. An actuator in the form of a throttle mechanism, generally indicated at 78, is provided on the pistol grip portion 28 for controlling the flow of air through fluid passageway 76. The throttle mechanism 78 has a manually engageable trigger 80 which is spring-biased forwardly towards a non-actuated position. Manually depressing the trigger 80 moves it rearwardly against its spring bias towards and into an actuated position. When the trigger 80 is moved to its actuated position, the throttle mechanism 78 allows air to flow from the air supply through the fluid passageway 76. When the trigger 80 is released and spring-biased to its non-actuated position, the throttle mechanism 78 prevents air from flowing from the air supply through fluid passageway 76. The construction of such a throttle mechanism 78 is well-known in the art and is not described in detail in the present application.

The tubular casing 38 has a plurality of exhaust holes 82 formed along the top portion thereof. As can be appreciated from FIG. 1, the fluid passageways 66, 68 are communicated to the casing interior beneath the motor shaft 36 and its associated vanes. A recessed slot 84 is formed in the lower portion of the casing 38 to allow air to the flow beneath the shaft 36. The pistol grip portion 28 has a fluid exhaust passageway (not shown) which opens outwardly from the bottom of the pistol grip portion 28. The three lines indicated at 86 illustrate the exhausting of air from the passageway. The fluid exhaust passageway communicates with the housing cavity 27 via opening 88. As a result of this construction, when the trigger 80 is depressed and the valve member 70 is open, pressurized air flows through fluid passageway 76, then fluid passageways 66, 68, 70 into the casing interior beneath the motor shaft 36, and then out the exhaust holes 82 and out through the opening 88. This air is then exhausted out the bottom of handle portion 28 via the exhaust passageway. The flow of pressurized air upwardly within the casing 38 and on the vanes of shaft 36 rotatably drives the shaft 36 about its axis.

In addition, there is a passageway (not shown) that communicates the housing cavity 27 to the interior of the forward housing portion 16. This passageway allows a portion of the exhausted airflow to circulate through the forward housing portion 16 to assist in cooling the impulse transmitting mechanism 12. Vents may be provided on housing portion 16 to allow the air to vent from passageway 16. The provision of such a passageway is well-known in the art and will not be detailed herein.

Figure 2A:
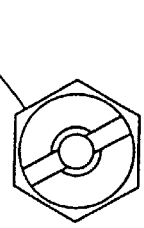
FIG. 2*a* is a rear elevated view showing the hexagonal configuration of the portion of the impulse manifold which connects to the motor.

The forward end portion of the shaft 36 defines a transmitting mechanism connecting portion 90 which has an interior cavity with a generally hexagonal shape when viewed in the axial direction of the shaft 36. The motor connecting portion 24 of the transmitting mechanism 12 extends rearwardly therefrom and, as best seen in FIG. 2*a*, has a generally hexagonal shape when viewed in the axial direction thereof. The motor connecting portion 24 is inserted into the transmitting mechanism connecting portion 90 with the hexagonal shapes thereof cooperating in a mating relationship so that rotation of the shaft 36 rotates the motor connecting portion 24 and the components of the transmitting mechanism 12 associated therewith.

To lock the supporting block 42 and external components of the motor 34, a cover member 92 slides over the shaft 36 and is engaged with the forward surface of the forward shaft supporting block 42. An intermediate connecting member 94 connects the forward housing portion 16 to the rearward housing portion 18. The intermediate member 94 has threaded end portions 96 that are threadingly received inside the forward and rearward housing portions 16, 18 to connect the two together.

Figure 2:
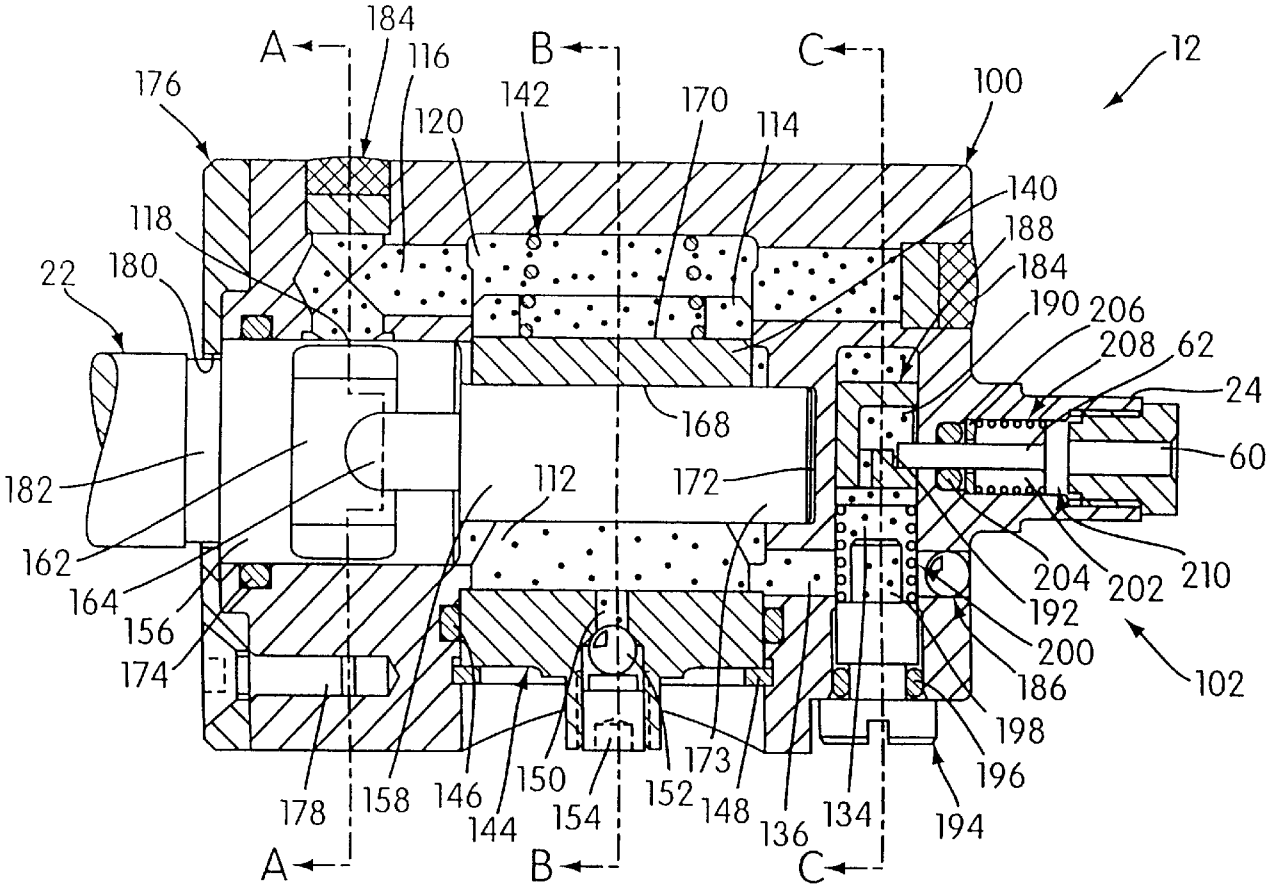
FIG. 2 is a cross-sectional view of an impulse mechanism utilized in the wrench of the present invention.

FIG. 2 shows a cross-section taken along the longitudinal axis of the pulse transmitting mechanism 12. The mechanism 12 comprises an impulse manifold 100 (also referred to as a driven component), the output spindle 22, and a shut-off structure, generally indicated at 102. As can be appreciated from the cross-sectional views of FIGS. 5A–5C, the impulse manifold 100 has a pair of generally flat exterior side surfaces 104, 106 and a pair of rounded exterior side surfaces 108, 110. The impulse manifold 100 is machined from steel and the motor connecting portion 24 is formed integrally therewith.

Figure 5C:
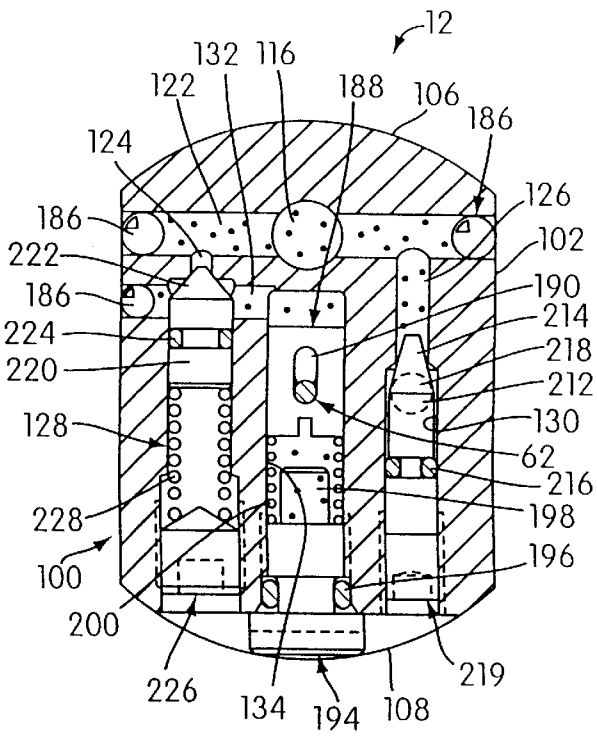
FIGS. 5A–5C are cross-sectional views respectively taken along section lines A—A, B—B, and C—C of FIG. 2.

A spindle receiving bore 112 is formed in the impulse manifold 100 along the longitudinal axis thereof. A radial impulse piston receiving bore 114 is formed in the impulse manifold 100 and extends generally radially with respect to the spindle receiving bore 112. A longitudinal high pressure fluid passageway 116 extends generally parallel to the spindle receiving bore 112 and has an opening 118 which opens to the bore 112 to allow communication therebetween. As best seen in FIG. 5C, a transverse high pressure fluid passageway 122 extends generally perpendicularly to the longitudinal passageway 116 and has passageways 124, 126 at opposing end portions thereof. These passageways 124, 126 open to and communicate with a pressure relief valve chamber 128 and a needle valve chamber 130, respectively. The relief valve chamber 128 has passageway 132 which opens to and communicates with a shut-off piston chamber 134. Low pressure fluid passageway 136 communicates the opposite end of the shut-off piston chamber 134 to the end of the piston receiving bore 114 opposing the piston 140.

An impulse piston 140 and a return spring 142 are disposed inside the impulse piston receiving bore 114 with the spring 142 engaging an interior surface of the manifold 100. Although only a single return spring 142 is shown, it is preferred to nest one return spring inside another return spring to provide a stronger spring return force in the same amount of space as the single return spring illustrated. A sealing cap 144 covers the impulse piston receiving bore 114 and seals its associated opening. A sealing element in the form of an annular rubber O-ring 146 fits within a recessed groove and provides a fluid seal in cooperation with the sealing cap 144. A retaining ring 148 is removably received within another recessed groove to releasably lock the sealing cap 144 in place. The seal cap 144 has an opening 150 formed therethrough with a ball 152 removably mounted therein and a closure plug 154 securing the ball 152 in place. The ball 152 and closure plug 154 function to seal opening 150 and prevent fluid from flowing therethrough. When the mechanism 12 is fully assembled, the manifold interior is filled with a substantially incompressible fluid, such as oil. The closure plug 154 and ball 152 can be removed to allow fluid to be added to or removed from the manifold interior as necessary through opening 150 and then be replaced in sealing relation.

Figure 3A:
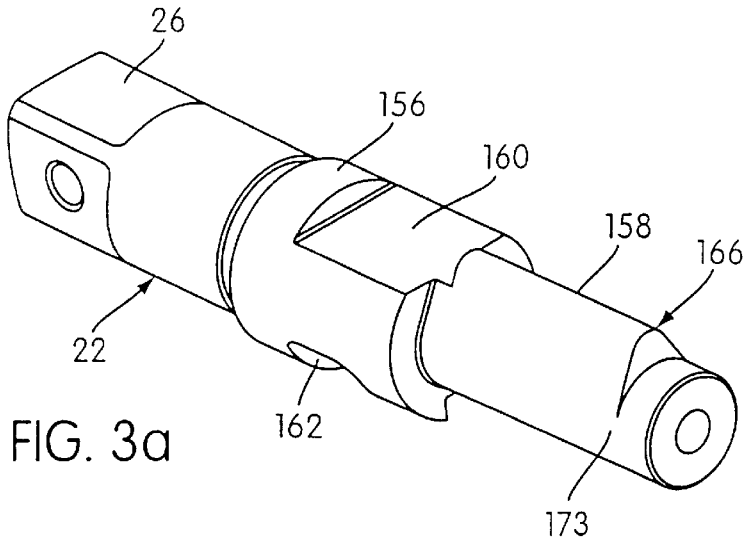
FIG. 3*a* is a perspective view of an output spindle of the impulse mechanism.
Figure 3B:
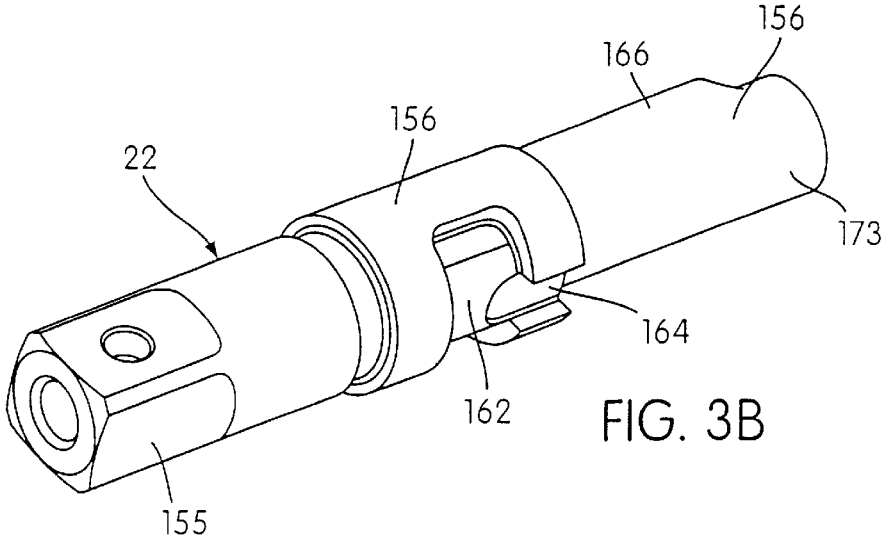
FIG. 3*b* is a perspective view of the output spindle of FIG. 3*a* taken from another side thereof.

Referring to FIGS. 3*a* and 3*b*, the output spindle 22 has a tool connecting portion 155 at the forward end thereof, an intermediate portion 156, and an eccentrically shaped impulse receiving portion 158. The tool connecting portion 155 connects with the tool mounting portion 26 such that rotation of the spindle 22 rotates the tool mounting portion 26 and the fastener engaging tool mounted thereto. The intermediate portion 156 has a flat recessed surface 160 and a pair of fluid bypass grooves 162, 164. Fluid bypass groove 162 extends generally circumferentially with respect to the axis of the spindle 22 and fluid bypass groove 164 extends generally axially with respect to the axis of the spindle 22. The eccentric impulse receiving portion 158 has a cam portion 166 extending radially therefrom.

Figure 4:
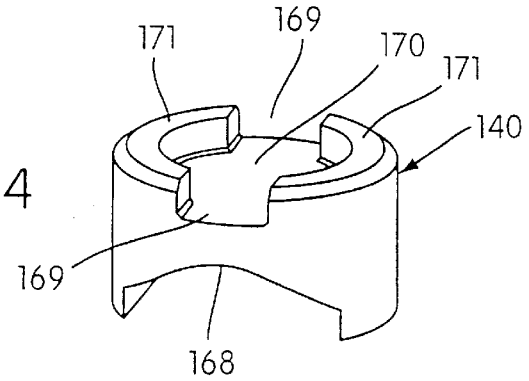
FIG. 4 is a perspective view of an impulse piston of the impulse mechanism.
Figure 5B:
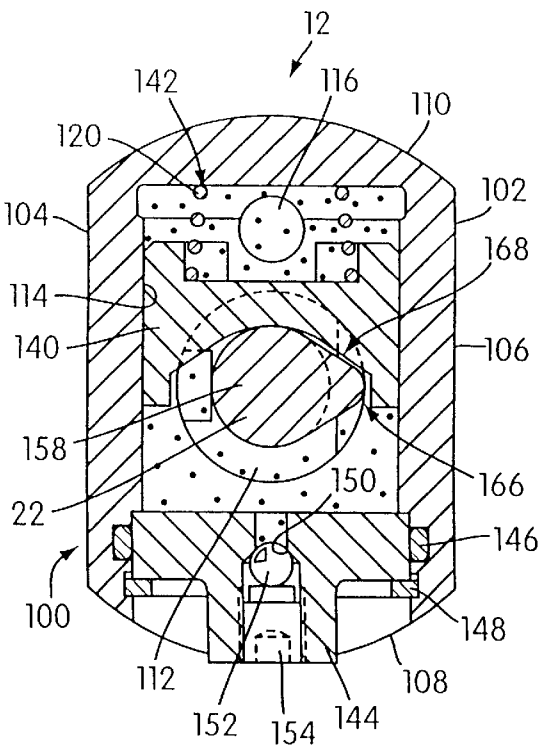
Figure 5A:
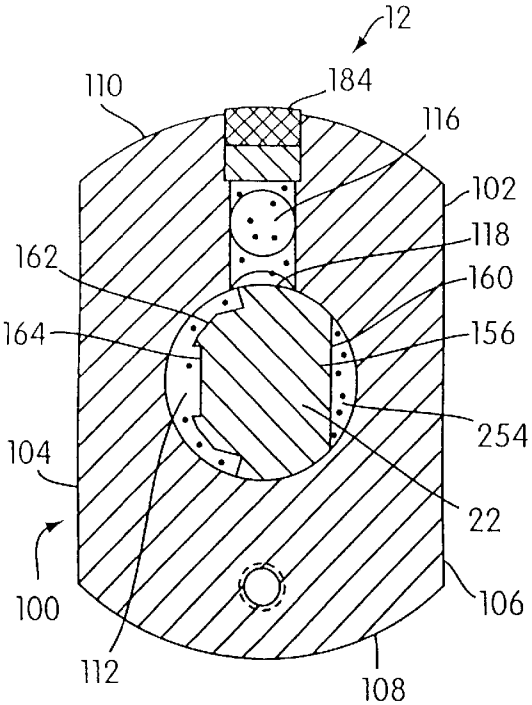
Figure 6A:
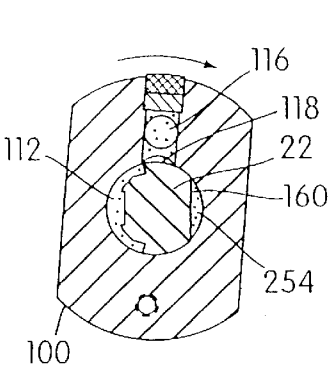
FIGS. 6A–6C are cross-sectional views similar to FIGS. 5A–5C and FIG. 6D is a partial cross-sectional view showing a shut-off structure which controls the flow of air to the motor, each of FIGS. 6A–6D showing the positions of the components illustrated therein when the impulse manifold is rotated approximately 5° from its initial position of FIGS. 5A–5C.
Figure 6B:
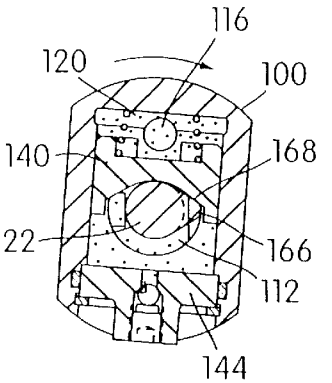
Figure 6C:
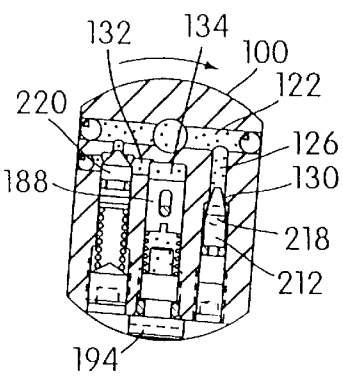
Figure 6D:
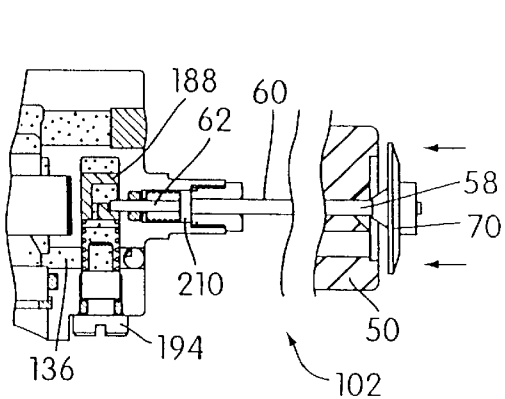
Figure 7A:
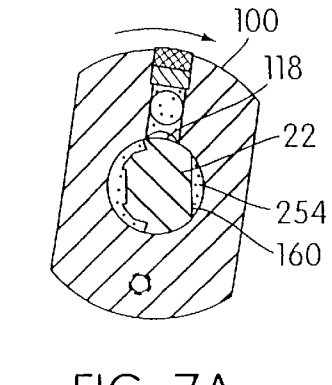
FIGS. 7A–7D are views similar to FIGS. 6A–6D but showing the positions of the components illustrated therein when the impulse manifold is rotated approximately 10° from its initial position.
Figure 7B:
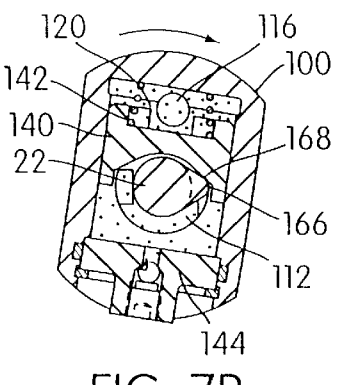
Figure 7C:
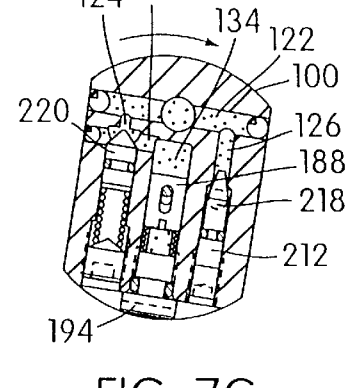
Figure 7D:
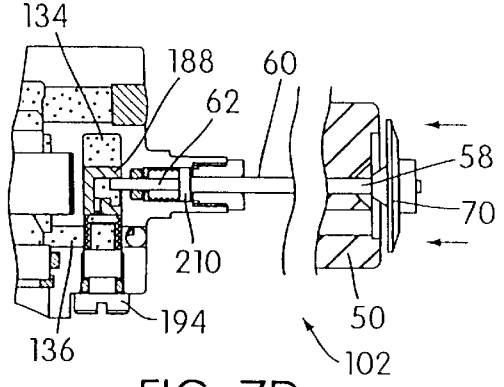
Figure 10A:
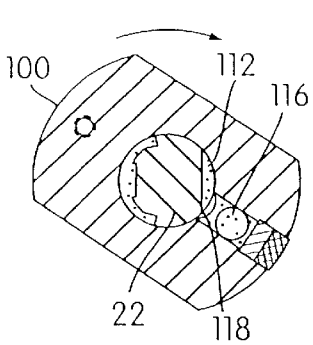
FIGS. 10A–10D are views similar to FIGS. 6A–6D but showing the positions of the components illustrated therein when the impulse manifold is rotated approximately 123° from its initial position.
Figure 10B:
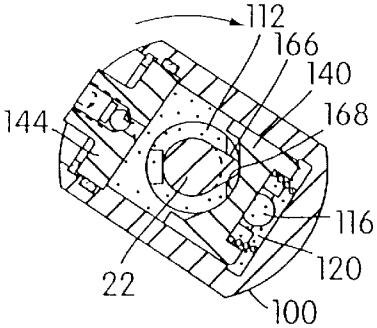
Figure 10C:
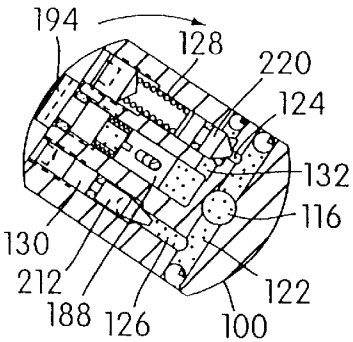
Figure 10D:
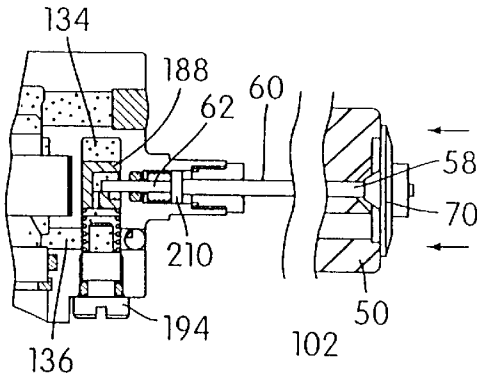
Figure 11A:
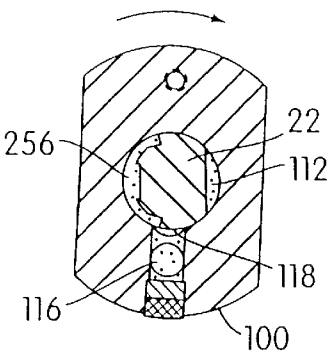
FIGS. 11A–11D are views similar to FIGS. 6A–6D but showing the positions of the components illustrated therein when the impulse manifold is rotated approximately 185° from its initial position.
Figure 11B:
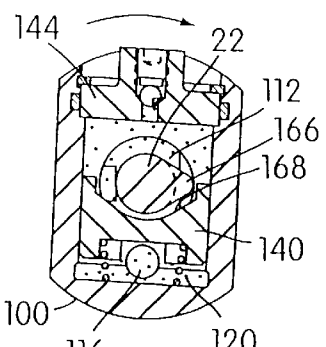
Figure 11C:
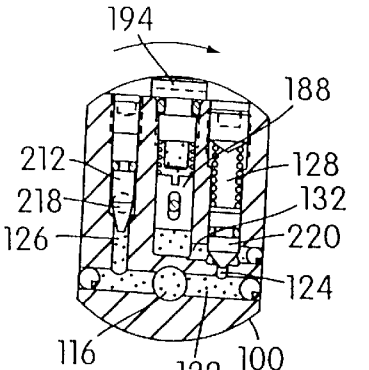
Figure 11D:
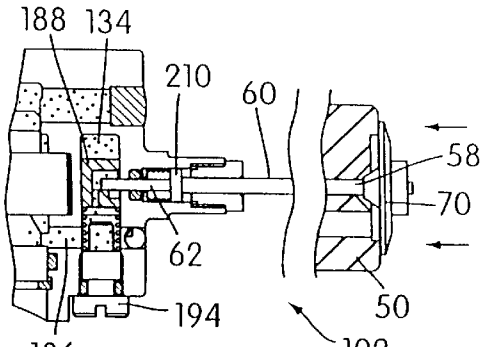
Figure 12A:
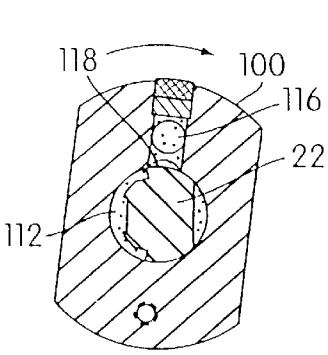
FIGS. 12A–12D are views similar to FIGS. 6A–6D but showing the positions of the components illustrated therein when the impulse manifold has completed one full rotation plus an additional 5° from its initial position with the shut-off valve closed.
Figure 12B:
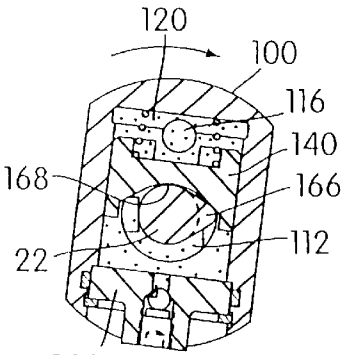
Figure 12C:
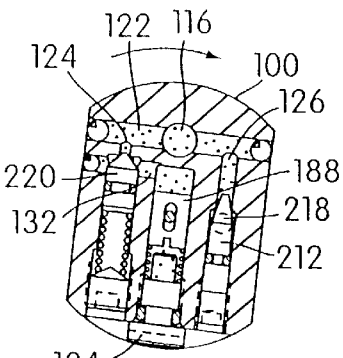
Figure 12D:
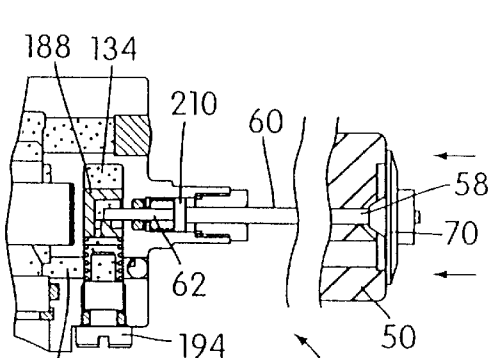
Figure 13A:
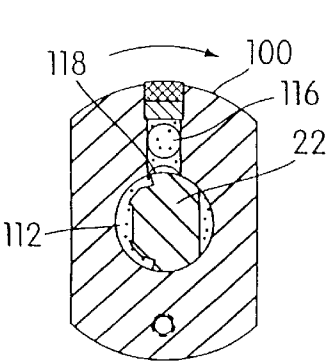
FIGS. 13A–13D are views similar to FIGS. 6A–6D but showing the positions of the components illustrated therein when the impulse manifold has returned to its initial state and with the shut-off valve open to allow airflow to the motor.
Figure 13B:
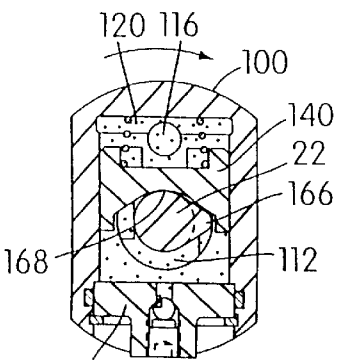
Figure 13C:
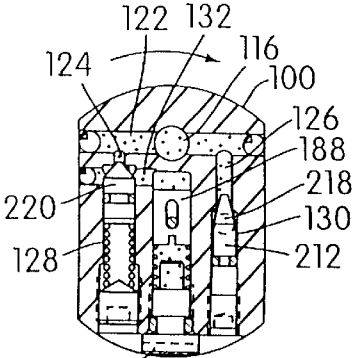
Figure 13D:
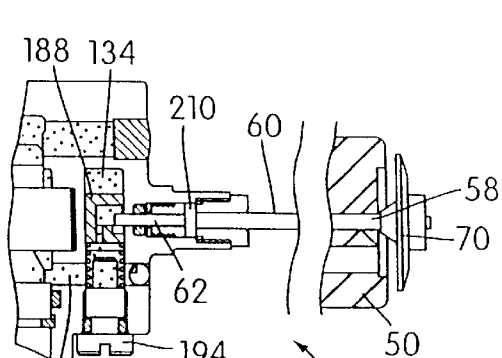
Figure 14:
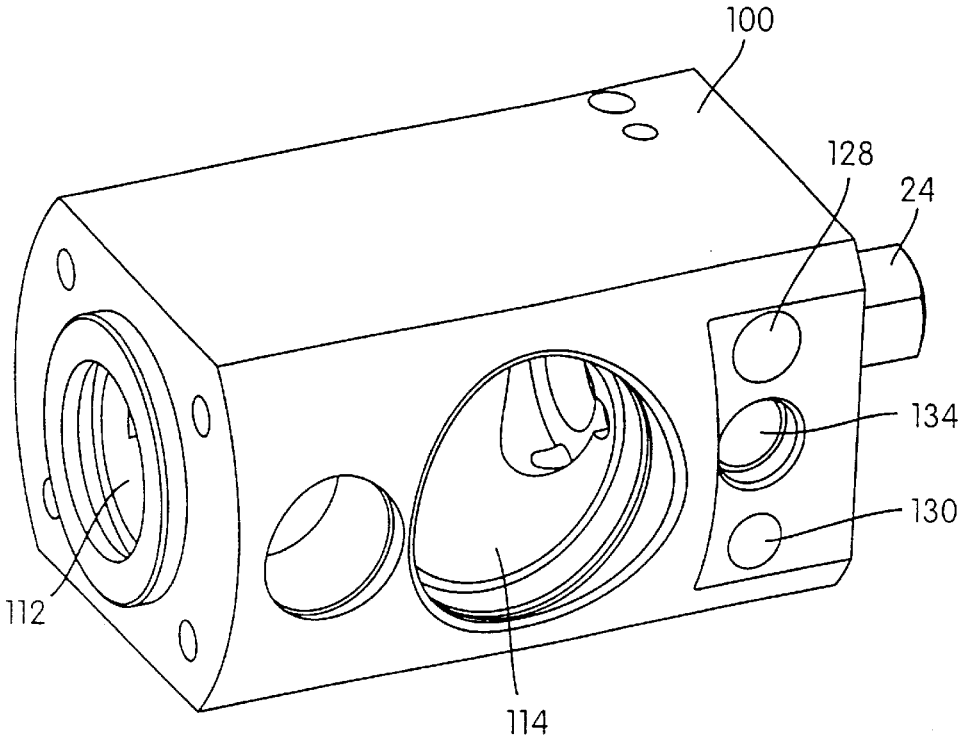
FIG. 14 is a perspective view of the impulse manifold of the impulse mechanism.
Figure 17:
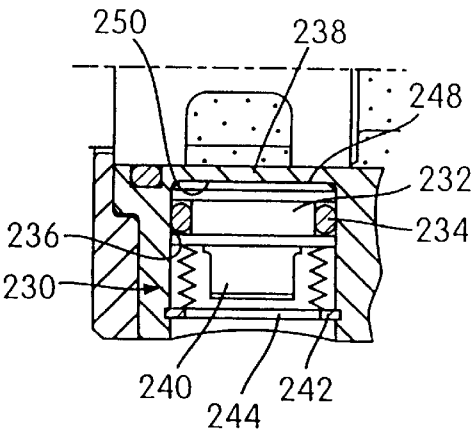
FIG. 17 is a view similar to FIG. 15 with the cross-section being taken generally perpendicularly to that taken in FIG. 15.
Figure 16:
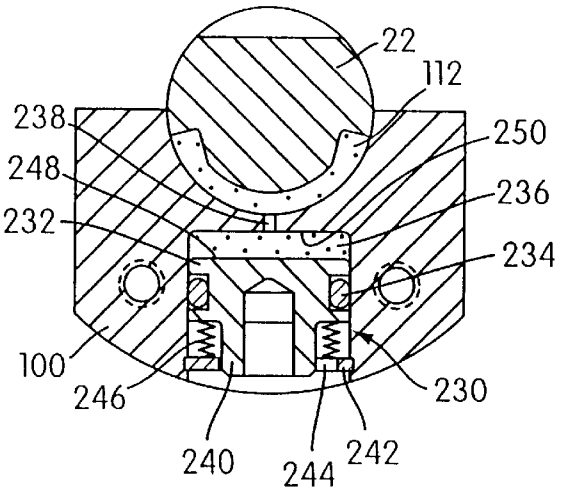
FIG. 16 is a view similar to FIG. 15 but showing the position of the components when the fluid pressure is sufficient to expand the reservoir.
Figure 15:
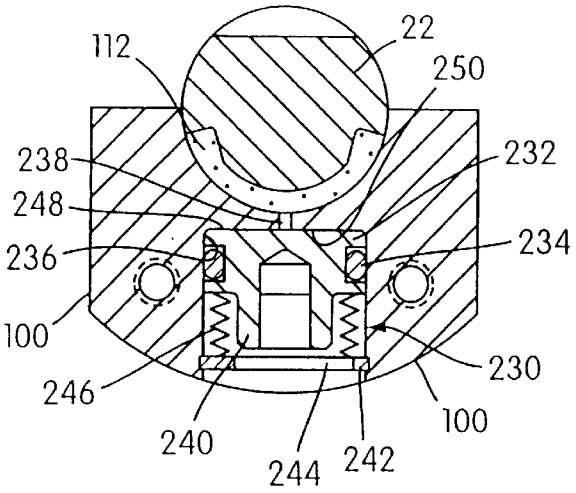
FIG. 15 is a partial cross-sectional view of the impulse mechanism taken through an expansion reservoir provided in the manifold, the view showing the position of the components when the fluid pressure in the manifold is insufficient to expand the reservoir.

The impulse piston 140 is shown alone in FIG. 4 and has a contoured camming surface 168 on one side and a spring bearing surface 170 opposing surface 168. As shown in FIGS. 2 and 5B The piston 140 is slidably received within bore 114 with the return spring 142 engaging the spring bearing surface 170 and the camming surface 168 facing inwardly into the spindle receiving bore 112. The piston 140 slides back and forth within bore 114 through reciprocating movements which will be detailed below. A pair of openings 169 are formed in the annular wall 171 that extends around surface 170. These openings 169 allow fluid to flow through passageway 116 without being blocked by the piston 140 when it has been moved radially outwardly.

As shown in FIGS. 2 and 5*b*, the spindle 22 is inserted into the spindle receiving bore 112 with the impulse receiving portion 158 adjacent the radial piston 140. As the impulse manifold 100 rotates relative to the output spindle 22, the camming surface 168 of piston 140 will engage the camming portion 166 of the impulse receiving portion 158 so that an impulse is delivered to the spindle 22 and the piston 140 is cammed radially outwardly. This operation will be detailed more fully below. The rear end 173 of spindle 22 is received within a cylindrical recess 172 formed at the end of the spindle receiving bore 112 for supported rotation.

An annular sealing element in the form of a rubber O-ring 174 is received within an annular groove located at the front end of the spindle receiving bore 112. The O-ring 174 engages the exterior of the intermediate portion 156 of the spindle 22 to provide a fluid seal and prevent the escape of oil. A manifold cover 176 is assembled to the front end of the manifold 100 and secured in place by one or more threaded fasteners 178. The spindle 22 extends forwardly through an opening 180 in the cover 176. It should be noted that the spindle 22 has a groove 182 adjacent the intermediate portion 156. The opening 180 has a smaller diameter than intermediate portion 156 to provide an abutting relationship which prevents the spindle 22 from moving axially within the bore 112.

Fluid passageways 116, 118, 122, 132 and 134 are formed by drilling holes into the manifold 100. Plugs in the form of cylindrical members 184 or balls 186 are press-fit in tight sealing relation into the respective holes to seal these fluid passageways.

A shut-off piston 188 is slidably mounted in the shut-off piston chamber 134 for reciprocating sliding movements therein. The piston 188 has an interior cavity 190 defining a stepped shoulder surface 192 which engages the plunger 62 engaged with actuating rod 60. A piston chamber plug 194 having an O-ring 196 provided thereon is inserted into and seals the shut-off piston chamber 134. The plug 194 has an inwardly extending projection 198 which serves to abut the piston 188 and limit its range of movement. A coil spring 200 is disposed between the piston 188 and plug 194. The spring 200 biases the piston 188 away from the plug 194 to a power supplying position as shown in FIG. 2. In this power supplying position, the plunger 62 abuts the shoulder surface 192 to prevent the rod 60 and the valve member 70 from moving forwardly to the valve member's closed position. The shut-off piston 188 and its associated components may also be considered part of the shut-off structure 102.

The motor connecting portion 24 of the manifold 100 has a bore 202 formed therein which opens to the shut-off piston chamber 34. An annular sealing element in the form of a rubber O-ring 204 fits into the end of the bore 202. A metal or plastic washer 206 is disposed adjacent the O-ring 204 and provides a suitable spring bearing surface for engagement with coil spring 208. The plunger 62 is inserted into bore 202 and extends into piston chamber 134. The plunger 62 has a radial flange 210 that provides a spring bearing surface for spring 208. The spring 208 biases the plunger 62 rearwardly to urge the rod 60 and valve member 70 towards a valve open position (to the right as viewed in FIG. 2).

A needle or pressure bleeding valve 212 is disposed in the needle valve chamber 130. The needle valve 212 has an elongated body with a conical end portion 214. An O-ring 216 is received within a groove on the needle valve 212 and forms a seal between the valve 212 and the chamber surface to prevent fluid flow therebetween. Chamber 130 has a wider diameter than passageway 126 and the needle valve 212 is disposed in the chamber 130 with a part of the conical end portion 214 extending into passageway 126. A low pressure fluid passageway 218 communicates the needle valve chamber 130 with the piston receiving bore 114. As a result of this construction, fluid is permitted to flow from passageway 122, through passageway 126, into chamber 130, and then into bore 114 through passageway 218. The conical end portion 214 of the valve obstructs the flow in a restricting manner so that pressure build-up in passageways 122 and 126 "bleeds" into chamber 130 and then flows on into bore 114. This prevents transient pressure increases in passageways 116 and 122 from forcing fluid out through passageway 218 in an unrestricted manner and instead causes such transient pressure increases to bleed off in a restricted manner. The end portion 219 of the needle valve 212 opposite conical end portion 214 is threaded and the end of the chamber 130 is also threaded. By turning the needle valve 212, these threads cooperate to move the needle valve 212 towards the point and away from the point where passageway 126 opens to chamber 130. Moving the needle valve 212 in such a manner varies the amount of restriction created by the conical end portion 214 and thus provides the needle valve 212 with adjustability to control the rate of pressure bleed.

The pressure relief valve chamber 128 has a pressure-relief valve 220 disposed therein. The valve 220 extends into passageway 132 and has a conical end portion 222 which engages and seals passageway 124 to prevent communication between passageway 122 and the shut-off piston chamber 134 via passageway 132. A rubber O-ring 224 is received within a groove on the valve 220 and provides a seal between the valve 220 and the chamber wall to prevent fluid flow therebetween. A threaded adjustment member 226 is threadingly received in a threaded end portion of the chamber 128. A coil spring 228 disposed between the valve 220 and the adjustment member 226 biases the valve 220 away from the member 226 to a closed, sealing position, as shown in FIG. 5C. When the fluid pressure in passageway 122 reaches a predetermined level, the pressure forces the valve 220 away from opening 124 against the bias of spring 228 to establish fluid communication between shut-off piston chamber 134 and passageway 122 via passageway 132. The pressure at which the valve 220 opens can be adjusted by turning the adjustment member 226 so as to compress or relax the spring 228. The more the spring 228 is compressed, the more pressure required to move valve 220; the less the spring 228 is compressed, the less pressure required to move valve 220.

Turning now to FIGS. 15–20, these Figures illustrate the components of an optional expansion reservoir assembly 230. Although it is preferred, this assembly 230 is optional and not shown in FIGS. 1–13. The assembly 230 includes a cylindrical plug 232 with an annular groove on the exterior thereof and a rubber O-ring 234 received within the groove. The plug 232 is slidably mounted in an overflow chamber 236 formed in the impulse manifold 100. The chamber 236 is spaced axially forwardly of the piston receiving bore 114. A small orifice 238 communicates the spindle receiving bore 112 and the overflow chamber 236. The plug 232 has an outwardly extending projection 240. An annular retaining ring 242 is removably mounted within a groove outwardly of the plug 232. The ring 242 has an opening 244 formed therethrough and the projection 240 extends through the opening 244. A spring 246 is disposed between the plug 232 and the ring 242 and biases the plug 232 inwardly toward an unexpanded position (shown in FIG. 15).

When the plug 232 is in its unexpanded position, the inner surface 248 of the plug 232 engages the outwardly facing surface 250 of the overflow chamber 236. During operation of the wrench 10, the fluid pressure inside bore 112 will be subject to transient increases. Because the orifice 238 has such a narrow diameter in relation to the sizes of bore 112 and chamber 236, little or no pressure will be communicated to chamber 236. However, as the temperature of the fluid increases over time (usually as a result of extended periods of operation), the pressure likewise increases in a steady, non-transient manner. This non-transient pressure increase is communicated to chamber 236. As a result, the plug 232 is forced radially outwardly against the bias of spring 246 and fluid will flow from bore 112 into chamber 236. This overflow keeps the pressure in bore 112, and hence all the other interior passageways, relatively constant during such non-transient pressure increases. This is particularly advantageous in view of the manner in which the pressure relief valve 220 functions. Specifically, if the overall, normal pressure were increased, then the difference between the normal pressure and the pressure at which the relief valve 220 unseals would be decreased and thus the maximum torque applied by the mechanism 12 would vary during operation.

This expansion chamber assembly 230 can also be used as storage for extra fluid which will compensate for any fluid leakage which may occur over time. To do this, the manifold 100 is filled beyond its maximum normal capacity until the pressure increases and a certain amount of fluid flows into chamber 236 forcing plug 232 against the bias of spring 246. If any fluid leaks from the manifold 100 through one of its sealed points, the fluid pressure in the manifold decreases correspondingly. As a result, the spring 246 forces the plug 232 inwardly so that fluid from chamber 236 flows through orifice 238 and into bore 112, thereby replenishing the lost fluid.

Operation

To begin a fastener driving operation, the air supply connecting portion 74 is connected to a supply of pressurized air and the fastener engaging tool is engaged with a threaded fastener. The trigger 80 is manually depressed so that the throttle mechanism 78 supplies pressurized air through passageway 76. At this point, the valve 70 is in its normal, open position and the shut-off piston 188 is in its power supplying position to prevent forward movement of the rod 60 and valve 70. Accordingly, the pressurized air flows through passageways 66 and 68 into the casing interior to cause rotation of shaft 36 and thereafter exhaust through openings 82 and 38. Rotation of the shaft 36 rotates the manifold 100 about its rotational axis as a result of the interconnection between connecting portions 24 and 90.

During the initial phases of the fastener tightening operation, the fastener offers little or no torsional resistance and the spindle 22 rotates along with the manifold 100 to rotate the fastener. Specifically, the impulse piston 140 engages the cam 166 on the impulse receiving portion 156 of the spindle 22 and causes the spindle 22 to rotate along with the manifold 100. Because the fastener offers little or no torsional resistance to rotation of the spindle 22, the return spring 142 causes the piston 140 and spindle 22 to remain engaged and prevents the spindle 22 from camming the piston 140 outwardly. This phase of the operation continues until the fastener begins to become snug and offer more than a nominal amount of torsional resistance. The point at which this begins is called the "snug point". The use of a single-acting piston 140 with a return spring 142 is particularly advantageous during this initial tightening phase of the operation because the spring 142 biases the piston 140 into engagement with the cam 66. As a result, the piston 140 is "pre-loaded" by the spring 142 and the spindle 22 and manifold 100 will rotate together longer than if the spring 142 were not provided.

At this snug point, the fastener is offering more than a nominal amount of resistance, but less than the predetermined maximum amount of torque which is to be applied to the fastener. During this snugging phase of the tightening operation, the manifold 100 rotates relative to the spindle 22 so that the impulse piston 140 engages the camming portion 166 of the impulse receiving portion 156. The engagement causes two actions: (a) the piston 140 delivers an impulse to the camming portion 166 of impulse receiving portion 156 to thereby turn the spindle 22 and fastener in the tightening direction, and (b) the impulse delivering surface 168 is cammed by the camming portion 166 to thereby move the piston 140 radially outwardly against the bias of spring 142. The point at which the snug point begins can be varied by using springs 142 of varying spring constants. This radially outward movement causes the spring bearing surface 170 to function as a pressurizing surface and increase the fluid pressure inside the radially outer end portion 120 of piston bore 114 and the longitudinal and transverse high pressure passageways 116 and 122. These passageways 116, 122 and outer end portion 120 may be considered together as a high pressure chamber. As the pressure in the high pressure chamber increases, a certain amount of the pressure bleeds off through passageway 126 via the needle valve 212. During this snugging phase, the spindle 22 is turned a sufficient amount during impulse so that the camming between surface 168 and camming portion 166 moves the piston 140 outwardly at a speed insufficient to cause the fluid pressure in the high pressure chamber to reach its predetermined maximum. Specifically, the needle valve 212 bleeds off enough pressure to ensure that the maximum pressure is not attained. This phase continues with the piston 140 repeatedly impulsing the spindle 22 until the torsional resistance offered by the fastener reaches its maximum value.

FIGS. 6–13 illustrate the manner in which the impulse transmitting mechanism 12 operates once the maximum torsional resistance of the fastener is reached. FIGS. 6*a–d* shows the positions of the transmitting mechanism and shut-off structure components when the manifold 100 has rotated 5° from the initial position of FIG. 5 relative to the spindle 22. In this position, the impulse delivering surface 168 initially engages the camming portion 66 of the spindle 22 and the piston 140 begins moving radially outwardly as a result of the camming action. The pressure relief valve 220 is closed and the shut-off piston 188 is in its power supplying position maintaining the valve 70 in its open position. The high pressure chamber is substantially sealed, and thus fluid pressure builds therein as the piston 140 begins moving radially outwardly. It should be noted that, although there are no seals between piston 140 and the surface of bore 114, the clearance between the piston 140 and bore 114 is sufficiently tight to prevent fluid from flowing therethrough during transient pressure increases.

FIGS. 7*a–d* show the components when the manifold 100 has rotated approximately 10° from its initial position relative to the spindle 22. Note that the spindle 22 itself has not rotated. Instead, the pressure builds up in the high pressure chamber at a fast enough rate to open the pressure relief valve 220. Opening of the pressure relief valve 220 communicates the chamber with the upper end of the shut-off piston chamber 134 and allows fluid to flow from the high pressure chamber. As a result, the piston 140 continues to move outwardly and further rotation of the manifold 100 causes the piston 140 to ride over the camming portion 166 in an outward camming manner. With the pressure relief valve 220 open, the fluid from the high pressure chamber now flows into the shut-off piston chamber 134 to move the piston 188 therein against the bias of spring 200 to its power shut-off position. It should be noted the projection 198 prevents the piston 188 from bottoming out and pinching against the plunger 62.

FIGS. 8*a–d* show the components of the transmitting mechanism 12 and the shut-off structure 102 with the manifold 100 rotated approximately 27° from its initial position. The air pressure behind valve member 70 forces the valve member 70 forwardly towards its closed position with rod 60 likewise being forced forwardly against the bias of spring 208. Also, high pressure chamber begins communicating with the piston receiving bore 114 via passageway 118 at point 252 to allow fluid flow therebetween. The flat surface 160 of spindle 22 cooperates with the interior surface of bore 112 to define bypass passageway 254 for establishing fluid communication between passageway 118 and the portion of the piston receiving bore 114 opposite piston 140.

FIGS. 9*a–d* shows the components of the transmitting mechanism 12 and the shut-off structure with the manifold 100 rotated approximately 56° from its initial position. Fluid is free to flow from the high pressure chamber into the spindle receiving bore 112 through passageways 118 and 254. Thus, the pressure in the high pressure chamber decreases and the relief valve 220 returns to its closed position under the bias of spring 228. The piston 140 continues to move radially outwardly against the bias of return spring 142, forcing fluid through passageway 118 into the spindle receiving bore 112. Also, the valve member 70 at this point is forced forwardly under air pressure to its closed position, thereby preventing airflow to the casing interior and hence shutting off communication between the motor 34 and the power supply (i.e., the pressurized air source).

FIGS. 10*a*–10*d* show the components of the transmitting mechanism 12 and the shut-off structure 102 with the manifold 100 rotated 123° from its initial position. At this point, the piston 140 has already been moved to its radially outermost point and the return spring 142 biases it back inwardly towards bore 112. During this movement, fluid in the end of piston receiving bore 114 opposite the piston 140 is permitted to flow back into the high pressure chamber via bypass passageway 254 and passageway 118. This prevents pressure build-up in the end of bore 114 opposite the piston 140. Spring 200 biases shut-off piston 188 back towards its power-supplying position. However, the piston 188 does not reach that position because it abuts against the plunger 62. The fluid displaced by piston 188 during this movement flows through the clearance defined between the piston exterior and the surface defining chamber 134 and then into the end of the piston receiving bore 112 opposite the piston 140 via passageway 136. Because the high pressure relief valve 220 is closed, fluid is prevented from flowing back through passage 132. It should be noted that as long as the user keeps the trigger 80 depressed, the throttle remains open and the pressurized air will keep valve member 70 in its closed position.

FIGS. 11*a–d* show the components of the transmitting mechanism 12 and the shut-off structure 102 with the manifold 100 rotated approximately 185° from its initial position. At this point, communication through passageway 254 is closed. However, radial and axial grooves 162, 164 (FIG. 3*b*) cooperate with the interior surface of bore 112 to define another bypass passageway 256 which, at this point of rotation, establishes communication between the high pressure chamber and the portion of bore 112 adjacent piston 140 via passageway 118. As a result, this arrangement provides further pressure relief for bore 114 by allowing fluid to flow therefrom into the high pressure chamber.

FIGS. 12*a–d* show the components of the transmitting mechanism 12 and the shut-off structure 102 with the manifold 100 again rotated to 5° past its initial position. Since the power supply to the motor 34 has been cut-off, the manifold 100 continues to rotate only under its own inertia. As a result, the shut-off cycle described above will be repeated a few more times until the manifold 100 comes to a complete stop. No additional tightening of the fastener occurs during these additional rotations.

FIGS. 13*a–d* show the components of the transmitting mechanism 12 and the shut-off structure 102 back at their initial position. The trigger 80 has been released, causing the throttle mechanism 78 to cut-off the air supply, and allowing the air trapped between the valve 70 and the throttle 78 to vent to the atmosphere so that the valve member 70 returns to its open position with the assistance of spring 208. Spring 200 then biases shut-off piston 188 fully to its power supplying position. The wrench 10 is now ready for another fastener tightening operation.

It should be noted that the symmetrical configuration of the piston 140 and eccentric impulse receiving portion 156 allows the wrench 10 to rotate fasteners in the opposite direction. Thus, the wrench 10 can be used for tightening or loosening fasteners. Of course, once the fasteners have been tightened to their predetermined torque, the wrench 10 cannot be used to loosen the fasteners unless the mechanism 12 is set for shut-off at a higher torque. This method of construction and operation is within the scope of the present invention. However, it is preferred to provide a bypass passageway (not shown) that bypasses the shut-off valve to communicate pressurized air to the motor when the valve is closed. The direction of fluid flow through this bypass passage also affects reverse rotation of the motor. A secondary switch is typically used to control fluid flow through this passage. The construction of such a passage is well known to those skilled in this art and thus will not be described herein.

It can thus be seen that the objectives of the present invention have been fully and effectively accomplished. It should be realized, however, that the foregoing preferred specific embodiment has been shown and described for the purpose of illustrating the structural and functional principles of the present invention and is subject to change without departure from such principles. Therefore, this invention includes all modifications, alterations, and substitutions encompassed within the spirit and scope of the appended claims.

It should be noted that the appended claims do not have limitations phrased in the "means or step for performing a specified function" format permitted by 35 U.S.C. § 112, paragraph 6. This is to make clear that the appended claims are not to be interpreted under § 112, paragraph 6 as being limited solely to the structure, material, or acts described in the present application and their equivalents.

What is claimed is:

1. An impulse wrench for use with a fastener engaging tool and a power supply to selectively rotate threaded fasteners, the engaging tool being constructed and arranged to be engaged with a fastener such that rotation of the tool rotates the fastener, said wrench comprising:

a housing;

an impulse manifold rotatably mounted within said housing for rotation about a driving axis, said manifold having a spindle receiving space extending generally along said driving axis and an impulse piston receiving space communicating with said spindle receiving space;

an impulse delivering piston mounted inside said impulse piston receiving space for reciprocating movement, said impulse delivering piston having an impulse delivering surface communicating with said spindle receiving space and a pressurizing surface, said piston and said piston receiving space being constructed and arranged such that said pressurizing surface and an outer end portion of said piston receiving space cooperate to define at least a portion of a high pressure chamber which is filled with a substantially incompressible fluid;

an output spindle rotatably mounted within said spindle receiving space and having a impulse receiving portion positioned adjacent the impulse delivering surface of said impulse piston, said output spindle being engageable with the fastener engaging tool such that rotation of said spindle rotates the fastener engaging tool;

a power-operated motor operatively connected to said impulse manifold, said motor being constructed and arranged to rotate said manifold about said driving axis thereof using power from the power supply;

an actuator selectively movable between (a) an actuated position enabling the power supply to communicate power to said motor and (b) a non-actuated position preventing the power supply from communicating power to said motor;

said impulse receiving portion of said output spindle and said impulse delivering surface of said impulse piston being constructed and arranged with respect to one another such that, when said motor is connected with the power supply and the fastener engaging tool is connected with said spindle and engaged with a threaded fastener, movement of said actuator to the actuated position thereof communicates power from the power supply to said motor to cause said motor to rotate said manifold relative to said spindle, thereby momentarily engaging the impulse delivering surface of said impulse piston with the impulse receiving portion of said spindle so that (a) an impulse is delivered to said spindle to said spindle which in turn transmits the torque to the fastener engaging tool and the fastener engaged therewith and (b) said impulse piston moves such that said pressurizing surface thereof momentarily increases the fluid pressure in said high pressure chamber to a level that is related to an amount of torsional resistance offered by the fastener;

an adjustable pressure responsive shut-off structure communicated with said high pressure chamber and being movable between (a) a power communicating position wherein said shut-off structure permits the power supply to communicate power to said motor and (b) a power shut-off position wherein said shut-off structure prevents the power supply from communicating power to said motor, said shut-off structure being constructed and arranged to move from said power communicating position thereof to said power shut-off position thereof in response to the fluid pressure in said high pressure chamber reaching a shut-off initiating level that is related to a selected maximum amount of torsional resistance to which the fastener is to be tightened, thereby preventing power from being communicated from the power supply to the motor when the torsional resistance of the fastener has reached the selected maximum amount, said shut-off structure being constructed and arranged such that the shut-off initiating level of the fluid pressure in said high pressure fluid chamber at which said shut-off structure moves to the power shut-off position can be adjusted, thereby allowing for selective control of the maximum torsional resistance for the fastener.

2. An impulse wrench according to claim 1, wherein said impulse manifold rotates about a driving axis and said spindle receiving space is a spindle receiving bore that extends along said driving axis.

3. An impulse wrench according to claim 2, wherein said motor is driven by pressurized fluid and wherein the power supply to which said motor is to be connected is a supply of pressurized fluid.

4. An impulse wrench according to claim 1, wherein said impulse piston receiving space is an impulse piston receiving bore that extends generally radially with respect to said driving axis and wherein said impulse piston is mounted in said impulse piston receiving bore for reciprocating radial movement with respect to said driving axis.

5. An impulse wrench according to claim 3, said motor is driven by pressurized air, and the supply of pressurized fluid is a supply of pressurized air and wherein said wrench further comprises:

structure defining an air intake passageway which is connectable to the supply of pressurized air;

said actuator being operatively associated with said air intake passageway and being constructed and arranged to permit pressurized air to flow through said intake passageway when in said actuated position thereof and to prevent pressurized air from flowing through said passageway when in said non-actuated position thereof;

said shut-off structure comprising a shut-off valve which is movable between (1) an open position wherein said valve permits pressurized air to flow into said motor and (2) a closed position wherein said valve prevents pressurized air from flowing into said motor;

said shut-off structure being constructed and arranged such that movement thereof from the power supplying position thereof to the power shut-off position thereof causes said valve to move from said open position thereof to said closed position thereof.

6. An impulse wrench according to claim 5, wherein said shut-off valve is positioned between the power supply and said motor such that the pressurized air from said motor flows against said valve to apply a biasing force thereto that urges said valve to the closed position thereof, said shut-off structure being constructed and arranged to maintain said valve in the open position thereof when in said power supplying position thereof, and to allow the pressurized air to move said valve to said closed position thereof when in said power shut-off position thereof.

7. An impulse wrench according to claim 6, wherein said manifold has a shut-off piston space formed therein and said shut-off valve is fixedly mounted on a rearward end portion of a reciprocating rod, and wherein said shut-off structure further comprises:

a plunger movably mounted adjacent said shut-off piston space and engaged with a forward end portion of said reciprocating rod;

a shut-off piston mounted for reciprocating movements within said shut-off piston space between (1) an operating position wherein said shut-off piston abuts said plunger to prevent said rod from moving in a valve closing direction so as to maintain said shut-off valve in the open position thereof and (2) an inoperative position wherein said shut-off piston allows said plunger and said reciprocating rod to move in the valve closing direction so as to allow the pressurized air to move said shut-off valve to the closed position thereof;

a valve biasing spring biasing said shut-off valve to the open position thereof when the pressurized air biasing said valve has been exhausted; and a pressure relief valve disposed between said high pressure chamber and said shut-off piston space, said pressure relief valve being constructed and arranged to move from a closed position preventing fluid communication between said high pressure chamber and said shut-off piston space to an open position establishing fluid communication between said high pressure chamber and said shut-off piston space in response to the pressure of the fluid in said high pressure chamber reaching the aforesaid shut-off initiating level;

said shut-off piston being constructed and arranged to move from said operative position thereof to said inoperative thereof when said pressure relief valve establishes fluid communication between said high pressure chamber and said shut-off piston space as a result of pressurized fluid flowing from said high pressure chamber into said shut-off piston space.

8. An impulse wrench according to claim 7, further comprising a pressure relief valve spring engaged with said pressure relief valve, said pressure relief valve spring being constructed and arranged to maintain said pressure relief valve in the closed position thereof until the pressure in said high pressure fluid chamber reaches said shut-off initiating pressure level thereof whereat the pressure is sufficient to move said pressure relief valve to the open position thereof against the biasing of said pressure relief valve spring.

9. An impulse wrench according to claim 8, further comprising a pressure relief valve adjustment member engaged with said pressure relief valve spring, said pressure relief valve adjustment member being constructed and arranged to allow the tension in said spring to be manually controlled by manually moving said adjustment member, thereby allowing the pressure at which said pressure relief valve moves to said open position thereof to be manually controlled.

10. An impulse wrench according to claim 7, wherein said manifold includes a low pressure fluid passageway communicating a portion of said shut-off piston space opposite said pressure-relief valve with said impulse piston receiving bore, said shut-off piston and said shut-off piston space providing a clearance therebetween which allows pressurized fluid to flow past said shut-off piston and into said impulse piston receiving bore via said low pressure fluid passageway after said pressure relief valve has returned to its closed position;

said impulse manifold further including an opening between said high pressure chamber and said impulse piston receiving bore;

said output spindle cooperating with the interior surface of said spindle receiving bore to define at least one fluid bypass passageway which communicates said high pressure chamber and a portion of said piston receiving bore opposite said piston after the fluid in said high pressure chamber has been pressurized.

11. An impulse wrench according to claim 7, wherein said shut-off structure further comprises a bleeding valve-associated fluid passageway communicating said high pressure chamber and said spindle receiving bore, and an adjustable pressure bleeding valve disposed in said bleeding valve-associated fluid passageway, said pressure bleeding valve being constructed and arranged to restrict fluid flow through said fluid passageway associated therewith such that fluid is forced from said high pressure chamber to said spindle receiving bore through said fluid passageway in a restricted manner when said impulse piston moves radially outwardly to increase the fluid pressure in said high pressure chamber;

said pressure bleeding valve being constructed and arranged such that the restriction it creates in the fluid passageway associated therewith can be manually adjusted so as to selectively control the rate at which the fluid is forced through said bleeding valve associated passageway, thereby allowing the relationship between the pressure applied to the fluid in said high pressure chamber by said piston and the torsional resistance reached by the fastener to be adjusted.

12. An impulse wrench according to claim 11, wherein said manifold has a needle valve receiving space communicated to said bleeding valve-associated passageway and wherein said pressure bleeding valve is an adjustable needle valve threadingly received within said needle valve receiving space, said needle valve being constructed and arranged to be manually adjusted as aforesaid by rotating said needle valve such that its threaded relationship with said needle valve receiving space converts the rotation thereof into axial movement.

13. An impulse wrench for use with a fastener engaging tool and a supply of pressurized fluid to selectively rotate threaded fasteners, the engaging tool being constructed and arranged to be engaged with a fastener such that rotation of the tool rotates the fastener, said wrench comprising:

a housing;

an impulse transmitting mechanism mounted in said housing, said mechanism comprising a driven component, an output spindle, and surfaces defining a high pressure chamber filled with a substantially incompressible fluid;

said output spindle being mounted for rotation with respect to said housing and being connectable with the fastener engaging tool such that rotation of said spindle rotates the fastener engaging tool;

a fluid-driven motor operatively connected to said driven component, said motor being constructed and arranged to rotate said driven component using pressurized fluid from said supply;

said driven component being rotatable with respect to said housing and said output spindle such that rotation of said driven component as a result of pressurized fluid being supplied to said motor rotates said spindle to affect a fastener tightening operation wherein the threaded fastener is tightened in such a manner that its torsional resistance to tightening increases throughout the operation;

said impulse transmitting mechanism being constructed and arranged such that the pressure of the fluid in said chamber increases during said fastener tightening operation to a level that is related to the torsional resistance offered by the fastener during the fastener tightening operation;

an actuator selectively movable between (a) an actuated position establishing fluid communication between the supply of pressurized fluid and said motor and (b) a non-actuated position preventing fluid communication between the supply of pressurized fluid and said motor; and an adjustable pressure responsive shut-off structure communicated with said high pressure chamber and having a shut-off valve that moves between (a) a power communicating position wherein said shutoff valve permits the pressurized fluid to flow from the supply thereof to said motor and (b) a power shut-off position wherein said shut-off valve prevents the pressurized fluid from flowing from the supply thereof to said motor, said shut-off valve being positioned between said motor and the supply of pressurized fluid such that the pressurized fluid flows against the valve so as to apply a biasing force that urges said valve towards said power shut-off position thereof;

said shut-off structure being constructed and arranged to maintain said shut-off valve in said power communicating position thereof while the pressure of the fluid in said high pressure chamber is below a shut-off initiating level that is related to a selected maximum amount of torsional resistance to which the fastener is to be tightened and to thereafter allow said valve to move to said power shut-off position thereof under the biasing force applied by the pressurized fluid flowing from the supply thereof in response to the pressure of the fluid in said high pressure chamber reaching the shut-off initiating level, thereby preventing the pressurized fluid from being communicated from the supply thereof to the motor when the torsional resistance offered by the fastener has reached the aforesaid maximum level, said shut-off structure being constructed and arranged such that the shut-off initiating level of the fluid pressure in said high pressure fluid chamber at which said shut-off structure moves to the power shut-off position can be adjusted, thereby allowing for selective control of the maximum torsional resistance for the fastener.

14. An impulse wrench according to claim 13, wherein said driven component is an impulse manifold that is rotatably mounted within said housing for rotation about a driving axis, said manifold having a spindle receiving bore extending generally along said driving axis and an impulse piston receiving bore extending generally radially with respect to said driving axis, and wherein said impulse mechanism further comprises an impulse piston mounted inside said impulse piston receiving bore for reciprocating radial movement with respect to said driving axis, said impulse piston having an impulse delivering surface facing generally into said spindle receiving space and a pressurizing surface facing generally away from said spindle receiving space, said piston and said piston receiving bore being constructed and arranged such that said pressurizing surface and a radially outer end portion of said piston receiving bore cooperate to define at least a portion of said high pressure chamber that is filled with said substantially incompressible fluid;

said output spindle being rotatably mounted inside said spindle receiving bore and having an impulse receiving portion which is positioned adjacent the impulse delivering surface of said impulse piston;

said impulse receiving portion of said output spindle and said impulse delivering portion of said impulse piston being constructed and arranged with respect to one another such that, when said motor is connected with the supply of pressurized fluid and the fastener engaging tool is connected with said spindle and engaged with a threaded fastener, movement of said actuator to the actuated position thereof communicates pressurized fluid from the supply thereof to said motor to cause said motor to rotate said manifold relative to said spindle, thereby momentarily engaging the impulse delivering surface of said impulse piston with the impulse receiving portion of said spindle so that (a) an impulse is delivered to said spindle to apply torque to said spindle the fastener engaging tool and the fastener engaged therewith and (b) said which in turn transmits the torque to impulse receiving portion cams said impulse delivering surface so as to move said impulse piston radially outwardly such that said pressurizing surface thereof momentarily increases the fluid pressure inside said high pressure chamber to the level that is related to the torsional resistance offered by the fastener.

15. An impulse wrench according to claim 14, wherein said motor is driven by pressurized air and wherein the supply of pressurized fluid is a supply of pressurized air.

16. An impulse wrench according to claim 15, further comprising:

structure defining an air intake passageway which is connectable to the supply of pressurized air;

said actuator being operatively associated with said air intake passageway and being constructed and arranged to permit pressurized air to flow through said intake passageway when in said actuated position thereof and to prevent pressurized air from flowing through said passageway when in said non-actuated position thereof.

17. An impulse wrench according to claim 16, wherein said manifold has a shut-off piston space formed therein and said shut-off valve is fixedly mounted on a rearward end portion of a reciprocating rod, and wherein said shut-off structure further comprises:

a plunger movably mounted adjacent said shut-off piston bore and engaged with a forward end portion of said reciprocating rod;

a shut-off piston mounted for reciprocating movements within said shut-off piston space between (1) an operating position wherein said shut-off piston abuts said plunger to prevent said rod from moving in a valve closing direction so as to maintain said shut-off valve in the open position thereof and (2) an inoperative position wherein said shut-off piston allows said plunger and said reciprocating rod to move in the valve closing direction so as to allow the pressurized air to move said shut-off valve to the closed position thereof;

a valve biasing spring biasing said shut-off valve to the open position thereof when the pressurized air biasing said valve has been exhausted; and a pressure relief valve disposed between said high pressure chamber and said shut-off piston space, said pressure relief valve being constructed and arranged to move from a closed position preventing fluid communication between said high pressure chamber and said shut-off piston space to an open position establishing fluid communication between said high pressure chamber and said shut-off piston space in response to the pressure of the fluid in said high pressure chamber reaching the aforesaid shut-off initiating level;

said shut-off piston being constructed and arranged to move from said operative position thereof to said inoperative thereof when said pressure relief valve establishes fluid communication between said high pressure chamber and said shut-off piston space as a result of pressurized fluid flowing from said high pressure chamber into said shut-off piston space.

18. An impulse wrench according to claim 17, further comprising a pressure relief valve spring engaged with said pressure relief valve, said pressure relief valve spring being constructed and arranged to maintain said pressure relief valve in the closed position thereof until the pressure in said high pressure fluid chamber reaches said shut-off initiating pressure level thereof whereat the pressure is sufficient to move said pressure relief valve to the open position thereof against the biasing of said pressure relief valve spring.

19. An impulse wrench according to claim 18, further comprising a pressure relief valve adjustment member engaged with said pressure relief valve spring, said pressure relief valve adjustment member being constructed and arranged to allow the tension in said spring to be manually controlled by moving said adjusting member, thereby allowing the pressure at which said pressure relief valve moves to said open position thereof to be manually controlled.

20. An impulse wrench according to claim 17, wherein said manifold includes a low pressure fluid passageway communicating a portion of said shut-off piston space opposite said pressure-relief valve with said impulse piston receiving bore, said shut-off piston and said shut-off piston space providing a clearance therebetween which allows pressurized fluid to flow past said shut-off piston and into said impulse piston receiving bore via said low pressure fluid passageway after said pressure relief valve has returned to its closed position;

said impulse manifold further including an opening between said high pressure chamber and said spindle receiving bore;

said output spindle cooperating with the interior surface of said spindle receiving bore to define at least one fluid bypass passageway which communicates said high pressure chamber and a portion of said impulse piston receiving bore opposite said impulse piston after the fluid in said high pressure chamber has been pressurized.

21. An impulse wrench according to claim 17, wherein said shut-off structure further comprises a bleeding valve-associated fluid passageway communicating said high pressure chamber and said spindle receiving bore, and an adjustable pressure bleeding valve disposed in said bleeding valve-associated fluid passageway, said pressure bleeding valve being constructed and arranged to restrict fluid flow through said fluid passageway associated therewith such that fluid is forced from said high pressure chamber to said spindle receiving bore through said fluid passageway in a restricted manner when said impulse piston moves radially outwardly to increase the fluid pressure said high pressure chamber;

said pressure bleeding valve being constructed and arranged such that the restriction it creates in the fluid passageway associated therewith can be manually adjusted so as to selectively control the rate at which the fluid is forced through said bleeding valve associated passageway, thereby allowing the relationship between the peak pressure reached by the fluid in said high pressure chamber and the torsional resistance reached by the fastener to be adjusted.

22. An impulse wrench according to claim 21, wherein said manifold has a needle valve receiving bore communicated to said bleeding valve-associated passageway and wherein said pressure bleeding valve is an adjustable needle valve threadingly received within said needle valve receiving bore, said needle valve being constructed and arranged to be manually adjusted as aforesaid by rotating said needle valve such that its threaded relationship with said needle valve receiving bore converts the rotation thereof into axial movement.

* * * * *

UNITED STATES PATENT AND TRADEMARK OFFICE

CERTIFICATE OF CORRECTION

PATENT NO. : 6,179,063 B1
DATED : January 30, 2001
INVENTOR(S) : John A. Borries and Kenneth F. Taucher It is certified that error appears in the above-identified patent and that said Letters Patent is hereby corrected as shown below:

Title page,
Item [56], References Cited,
U.S. PATENT DOCUMENTS
Please add:

| | | |
|---|---|---|
| -- 3,210,959 | 10/1965 | Brown |
| 4,604,943 | 08/1986 | Pauley |
| 4,635,731 | 01/1987 | Wallace et al. |
| 5,080,181 | 01/1992 | Tatsuno |
| 5,082,066 | 01/1992 | Schoeps |
| 5,505,676 | 04/1996 | Bookshar |
| 5,735,354 | 04/1998 | Weidner et al. |

FOREIGN PATENT DOCUMENTS

| | | |
|---|---|---|
| 631851 | 01/1995 | (Europe) |

OTHER PUBLICATIONS
BOSCH Manual, pages 1-55 --

Signed and Sealed this

Eleventh Day of June, 2002

*Attest:*

*Attesting Officer*

JAMES E. ROGAN
*Director of the United States Patent and Trademark Office*